US011013960B2

(12) United States Patent
Watterson et al.

(10) Patent No.: US 11,013,960 B2
(45) Date of Patent: May 25, 2021

(54) EXERCISE SYSTEM INCLUDING A STATIONARY BICYCLE AND A FREE WEIGHT CRADLE

(71) Applicant: ICON Health & Fitness, Inc., Logan, UT (US)

(72) Inventors: Scott R. Watterson, Providence, UT (US); William T. Dalebout, North Logan, UT (US)

(73) Assignee: ICON HEALTH & FITNESS, INC., Logan, UT (US)

( * ) Notice: Subject to any disclaimer, the term of this patent is extended or adjusted under 35 U.S.C. 154(b) by 0 days.

(21) Appl. No.: 17/115,690

(22) Filed: Dec. 8, 2020

(65) Prior Publication Data

US 2021/0086032 A1 Mar. 25, 2021

Related U.S. Application Data

(63) Continuation of application No. 16/299,668, filed on Mar. 12, 2019, now Pat. No. 10,864,407, which is a (Continued)

(51) Int. Cl.
*A63B 24/00* (2006.01)
*A63B 71/00* (2006.01)

(Continued)

(52) U.S. Cl.
CPC ..... *A63B 24/0087* (2013.01); *A63B 21/072* (2013.01); *A63B 21/075* (2013.01);

(Continued)

(58) Field of Classification Search
CPC ..... A63B 24/0087; A63B 71/0036; A63B 21/072; A63B 22/0242; A63B 22/0605;

(Continued)

(56) References Cited

U.S. PATENT DOCUMENTS 4,023,795 A 5/1977 Pauls
4,300,760 A 11/1981 Bobroff (Continued)

FOREIGN PATENT DOCUMENTS

CN 203989681 12/2014
KR 100829774 5/2008

(Continued)

OTHER PUBLICATIONS

U.S. Appl. No. 29/568,648, filed Jun. 20, 2016, ICON Health & Fitness, Inc.

(Continued)

*Primary Examiner* — Sundhara M Ganesan
(74) *Attorney, Agent, or Firm* — Maschoff Brennan

(57) ABSTRACT

An exercise system may include a stationary bicycle, a free weight cradle incorporated into the stationary bicycle, pedals incorporated into the stationary bicycle, a display, one or more processors, and memory. The memory may store programmed instructions of the programmed workout that, when executed by the one or more processors, cause the one or more processors to: automatically alternate, by the programmed instructions of the programmed workout, between biking portions of the programmed workout and lifting portions of the programmed workout; automatically control, by the programmed instructions of the programmed workout, a resistance level of the pedals during the biking portions of the programmed workout; and automatically present, by the programmed instructions of the programmed workout, lifting instructions on the display, the lifting instructions configured to instruct a user on lifting one or more free weights during the lifting portions of the programmed workout.

20 Claims, 7 Drawing Sheets

Related U.S. Application Data continuation of application No. 15/461,040, filed on Mar. 16, 2017, now Pat. No. 10,293,211.

(60) Provisional application No. 62/310,503, filed on Mar. 18, 2016.

(51) Int. Cl.

| | |
|---|---|
| ***A63B 21/072*** | (2006.01) |
| ***A63B 22/06*** | (2006.01) |
| ***A63B 21/075*** | (2006.01) |
| ***A63B 71/06*** | (2006.01) |
| ***A63B 69/00*** | (2006.01) |
| ***A63B 22/00*** | (2006.01) |
| ***A63B 22/02*** | (2006.01) |

(52) U.S. Cl.

CPC ..... *A63B 21/0726* (2013.01); *A63B 22/0242* (2013.01); *A63B 22/0605* (2013.01); *A63B 24/0062* (2013.01); *A63B 24/0075* (2013.01); *A63B 71/0036* (2013.01); *A63B 71/0622* (2013.01); *A63B 71/0686* (2013.01); *A63B 21/0724* (2013.01); *A63B 22/0023* (2013.01); *A63B 22/0048* (2013.01); *A63B 22/0076* (2013.01); *A63B 22/02* (2013.01); *A63B 22/0664* (2013.01); *A63B 69/0057* (2013.01); *A63B 2024/0093* (2013.01); *A63B 2071/063* (2013.01); *A63B 2071/065* (2013.01); *A63B 2071/0625* (2013.01); *A63B 2220/17* (2013.01); *A63B 2220/20* (2013.01); *A63B 2220/30* (2013.01); *A63B 2220/51* (2013.01); *A63B 2220/58* (2013.01); *A63B 2220/805* (2013.01); *A63B 2220/807* (2013.01); *A63B 2225/20* (2013.01); *A63B 2225/50* (2013.01); *A63B 2225/68* (2013.01); *A63B 2225/74* (2020.08); *A63B 2230/01* (2013.01); *A63B 2230/06* (2013.01); *A63B 2230/062* (2013.01)

(58) Field of Classification Search

CPC ..... A63B 21/0726; A63B 21/075; A63B 24/0062; A63B 24/0075; A63B 71/0622; A63B 71/0686; A63B 2225/74; A63B 2220/51; A63B 21/0724; A63B 69/0057; A63B 2220/20; A63B 22/0048; A63B 22/0076; A63B 2024/0093; A63B 2071/063; A63B 2071/065; A63B 22/0023; A63B 2230/01; A63B 2225/20; A63B 2220/807; A63B 2220/58; A63B 2225/68; A63B 2225/50; A63B 2220/30; A63B 2220/805; A63B 2230/062; A63B 22/0664; A63B 2230/06; A63B 2220/17; A63B 22/02; A63B 2071/0625

See application file for complete search history.

(56) References Cited

U.S. PATENT DOCUMENTS

| | | | |
|---|---|---|---|
| 4,413,821 | A | 11/1983 | Centafanti |
| D286,311 | S | 10/1986 | Martinell et al. |
| 4,681,318 | A | 7/1987 | Lay |
| 4,684,126 | A | 8/1987 | Dalebout et al. |
| 4,705,028 | A | 11/1987 | Melby |
| 4,728,102 | A | 3/1988 | Pauls |
| 4,750,736 | A | 6/1988 | Watterson |
| 4,796,881 | A | 1/1989 | Watterson |
| 4,813,667 | A | 3/1989 | Watterson |
| 4,830,371 | A | 5/1989 | Lay |
| 4,844,451 | A | 7/1989 | Bersonnet et al. |
| 4,850,585 | A | 7/1989 | Dalebout |
| D304,849 | S | 11/1989 | Watterson |
| 4,880,225 | A | 11/1989 | Lucas et al. |
| 4,883,272 | A | 11/1989 | Lay |
| D306,468 | S | 3/1990 | Watterson |
| D306,891 | S | 3/1990 | Watterson |
| 4,913,396 | A | 4/1990 | Dalebout et al. |
| D307,614 | S | 5/1990 | Bingham et al. |
| D307,615 | S | 5/1990 | Bingham et al. |
| 4,921,242 | A | 5/1990 | Watterson |
| 4,932,650 | A | 6/1990 | Bingham et al. |
| D309,167 | S | 7/1990 | Griffin |
| D309,485 | S | 7/1990 | Bingham et al. |
| 4,938,478 | A | 7/1990 | Lay |
| D310,253 | S | 8/1990 | Bersonnet et al. |
| 4,955,599 | A | 9/1990 | Bersonnet et al. |
| 4,971,316 | A | 11/1990 | Dalebout et al. |
| D313,055 | S | 12/1990 | Watterson |
| 4,974,832 | A | 12/1990 | Dalebout |
| 4,979,737 | A | 12/1990 | Kock |
| 4,981,294 | A | 1/1991 | Dalebout et al. |
| D315,765 | S | 3/1991 | Measom et al. |
| 4,998,725 | A | 3/1991 | Watterson et al. |
| 5,000,443 | A | 3/1991 | Dalebout et al. |
| 5,000,444 | A | 3/1991 | Dalebout et al. |
| D316,124 | S | 4/1991 | Dalebout et al. |
| 5,013,033 | A | 5/1991 | Watterson et al. |
| 5,014,980 | A | 5/1991 | Bersonnet et al. |
| 5,016,871 | A | 5/1991 | Dalebout et al. |
| D318,085 | S | 7/1991 | Jacobson et al. |
| D318,086 | S | 7/1991 | Bingham et al. |
| D318,699 | S | 7/1991 | Jacobson et al. |
| 5,029,801 | A | 7/1991 | Dalebout et al. |
| 5,034,576 | A | 7/1991 | Dalebout et al. |
| 5,058,881 | A | 10/1991 | Measom |
| 5,058,882 | A | 10/1991 | Dalebout et al. |
| D321,388 | S | 11/1991 | Dalebout |
| 5,062,626 | A | 11/1991 | Dalebout et al. |
| 5,062,627 | A | 11/1991 | Bingham |
| 5,062,632 | A | 11/1991 | Dalebout et al. |
| 5,062,633 | A | 11/1991 | Engel et al. |
| 5,067,710 | A | 11/1991 | Watterson et al. |
| 5,072,929 | A | 12/1991 | Peterson et al. |
| D323,009 | S | 1/1992 | Dalebout et al. |
| D323,198 | S | 1/1992 | Dalebout et al. |
| D323,199 | S | 1/1992 | Dalebout et al. |
| D323,863 | S | 2/1992 | Watterson |
| 5,088,729 | A | 2/1992 | Dalebout |
| 5,090,694 | A | 2/1992 | Pauls et al. |
| 5,102,380 | A | 4/1992 | Jacobson et al. |
| 5,104,120 | A | 4/1992 | Watterson et al. |
| 5,108,093 | A | 4/1992 | Watterson |
| D326,491 | S | 5/1992 | Dalebout |
| 5,122,105 | A | 6/1992 | Engel et al. |
| 5,135,216 | A | 8/1992 | Bingham et al. |
| 5,135,458 | A | 8/1992 | Huang |
| 5,147,265 | A | 9/1992 | Pauls et al. |
| 5,149,084 | A | 9/1992 | Dalebout et al. |
| 5,149,312 | A | 9/1992 | Croft et al. |
| 5,158,520 | A | 10/1992 | Lemke |
| 5,171,196 | A | 12/1992 | Lynch |
| D332,347 | S | 1/1993 | Raadt et al. |
| 5,190,505 | A | 3/1993 | Dalebout et al. |
| 5,192,255 | A | 3/1993 | Dalebout et al. |
| 5,195,937 | A | 3/1993 | Engel et al. |
| 5,203,826 | A | 4/1993 | Dalebout |
| D335,511 | S | 5/1993 | Engel et al. |
| D335,905 | S | 5/1993 | Cutter et al. |
| D336,498 | S | 6/1993 | Engel et al. |
| 5,217,487 | A | 6/1993 | Engel et al. |
| D337,361 | S | 7/1993 | Engel et al. |
| D337,666 | S | 7/1993 | Peterson et al. |
| D337,799 | S | 7/1993 | Cutter et al. |
| 5,226,866 | A | 7/1993 | Engel et al. |
| 5,242,339 | A | 9/1993 | Thornton |
| 5,244,446 | A | 9/1993 | Engel et al. |
| 5,247,853 | A | 9/1993 | Dalebout |
| 5,259,611 | A | 11/1993 | Dalebout et al. |
| D342,106 | S | 12/1993 | Campbell et al. |
| 5,279,528 | A | 1/1994 | Dalebout et al. |

(56) References Cited

U.S. PATENT DOCUMENTS

| | | | |
|---|---|---|---|
| D344,112 | S | 2/1994 | Smith |
| D344,557 | S | 2/1994 | Ashby |
| 5,282,776 | A | 2/1994 | Dalebout |
| 5,295,931 | A | 3/1994 | Dreibelbis et al. |
| 5,302,161 | A | 4/1994 | Loubert et al. |
| D347,251 | S | 5/1994 | Dreibelbis et al. |
| 5,316,534 | A | 5/1994 | Dalebout et al. |
| D348,493 | S | 7/1994 | Ashby |
| D348,494 | S | 7/1994 | Ashby |
| 5,328,164 | A | 7/1994 | Soga |
| D349,931 | S | 8/1994 | Bostic et al. |
| 5,336,142 | A | 8/1994 | Dalebout et al. |
| D351,202 | S | 10/1994 | Bingham |
| D351,435 | S | 10/1994 | Peterson et al. |
| D351,633 | S | 10/1994 | Bingham |
| D352,534 | S | 11/1994 | Dreibelbis et al. |
| D353,422 | S | 12/1994 | Bostic et al. |
| 5,372,559 | A | 12/1994 | Dalebout et al. |
| 5,374,228 | A | 12/1994 | Buisman et al. |
| 5,382,221 | A | 1/1995 | Hsu et al. |
| 5,385,520 | A | 1/1995 | Lepine |
| 5,387,168 | A | 2/1995 | Bostic |
| 5,393,690 | A | 2/1995 | Fu et al. |
| D356,128 | S | 3/1995 | Smith et al. |
| 5,429,563 | A | 7/1995 | Engel et al. |
| 5,431,612 | A | 7/1995 | Holden |
| D360,915 | S | 8/1995 | Bostic et al. |
| 5,468,205 | A | 11/1995 | McFall et al. |
| 5,489,249 | A | 2/1996 | Brewer et al. |
| 5,492,517 | A | 2/1996 | Bostic et al. |
| D367,689 | S | 3/1996 | Wilkinson et al. |
| 5,511,740 | A | 4/1996 | Loubert et al. |
| 5,512,025 | A | 4/1996 | Dalebout et al. |
| D370,949 | S | 6/1996 | Furner |
| D371,176 | S | 6/1996 | Furner |
| 5,529,553 | A | 6/1996 | Finlayson |
| 5,540,429 | A | 7/1996 | Dalebout et al. |
| 5,549,533 | A | 8/1996 | Olson et al. |
| 5,554,085 | A | 9/1996 | Dalebout |
| 5,569,128 | A | 10/1996 | Dalebout |
| 5,591,105 | A | 1/1997 | Dalebout et al. |
| 5,591,106 | A | 1/1997 | Dalebout et al. |
| 5,595,556 | A | 1/1997 | Dalebout et al. |
| 5,607,375 | A | 3/1997 | Dalebout |
| 5,611,539 | A | 3/1997 | Watterson |
| 5,622,527 | A | 4/1997 | Watterson et al. |
| 5,626,538 | A | 5/1997 | Dalebout et al. |
| 5,626,540 | A | 5/1997 | Hall |
| 5,626,542 | A | 5/1997 | Dalebout et al. |
| D380,024 | S | 6/1997 | Novak et al. |
| 5,637,059 | A | 6/1997 | Dalebout |
| D380,509 | S | 7/1997 | Wilkinson et al. |
| 5,643,153 | A | 7/1997 | Nylen et al. |
| 5,645,509 | A | 7/1997 | Brewer et al. |
| D384,118 | S | 9/1997 | Deblauw |
| 5,662,557 | A | 9/1997 | Watterson et al. |
| 5,667,461 | A | 9/1997 | Hall |
| 5,669,857 | A | 9/1997 | Watterson et al. |
| 5,672,140 | A | 9/1997 | Watterson et al. |
| 5,674,156 | A | 10/1997 | Watterson et al. |
| 5,674,453 | A | 10/1997 | Watterson et al. |
| 5,676,624 | A | 10/1997 | Watterson et al. |
| 5,683,331 | A | 11/1997 | Dalebout |
| 5,683,332 | A | 11/1997 | Watterson et al. |
| D387,825 | S | 12/1997 | Fleck et al. |
| 5,695,433 | A | 12/1997 | Buisman |
| 5,695,434 | A | 12/1997 | Dalebout et al. |
| 5,695,435 | A | 12/1997 | Watterson et al. |
| 5,702,325 | A | 12/1997 | Watterson et al. |
| 5,704,879 | A | 1/1998 | Watterson et al. |
| 5,718,657 | A | 2/1998 | Dalebout et al. |
| 5,720,200 | A | 2/1998 | Anderson et al. |
| 5,720,698 | A | 2/1998 | Dalebout et al. |
| D392,006 | S | 3/1998 | Dalebout et al. |
| 5,722,922 | A | 3/1998 | Watterson et al. |
| 5,733,229 | A | 3/1998 | Dalebout et al. |
| 5,743,833 | A | 4/1998 | Watterson et al. |
| 5,762,584 | A | 6/1998 | Daniels |
| 5,762,587 | A | 6/1998 | Dalebout et al. |
| 5,772,560 | A | 6/1998 | Watterson et al. |
| 5,810,698 | A | 9/1998 | Hullett et al. |
| 5,827,155 | A | 10/1998 | Jensen |
| 5,830,114 | A | 11/1998 | Halfen et al. |
| 5,860,893 | A | 1/1999 | Watterson et al. |
| 5,860,894 | A | 1/1999 | Dalebout et al. |
| 5,899,834 | A | 5/1999 | Dalebout et al. |
| 5,921,892 | A | 7/1999 | Easton |
| D412,953 | S | 8/1999 | Armstrong |
| D413,948 | S | 9/1999 | Dalebout |
| 5,951,441 | A | 9/1999 | Dalebout |
| 5,951,448 | A | 9/1999 | Bolland |
| D416,596 | S | 11/1999 | Armstrong |
| 6,003,166 | A | 12/1999 | Hald et al. |
| 6,019,710 | A | 2/2000 | Dalebout et al. |
| 6,027,429 | A | 2/2000 | Daniels |
| 6,033,347 | A | 3/2000 | Dalebout et al. |
| D425,940 | S | 5/2000 | Halfen et al. |
| 6,059,692 | A | 5/2000 | Hickman |
| D428,949 | S | 8/2000 | Simonson |
| 6,113,519 | A | 9/2000 | Goto |
| 6,123,646 | A | 9/2000 | Colassi |
| 6,171,217 | B1 | 1/2001 | Cutler |
| 6,171,219 | B1 | 1/2001 | Simonson |
| 6,174,267 | B1 | 1/2001 | Dalebout |
| 6,193,631 | B1 | 2/2001 | Hickman |
| 6,228,003 | B1 | 5/2001 | Hald et al. |
| 6,238,323 | B1 | 5/2001 | Simonson |
| 6,251,052 | B1 | 6/2001 | Simonson |
| 6,261,022 | B1 | 7/2001 | Dalebout et al. |
| 6,280,362 | B1 | 8/2001 | Dalebout et al. |
| 6,296,594 | B1 | 10/2001 | Simonson |
| D450,872 | S | 11/2001 | Dalebout et al. |
| 6,312,363 | B1 | 11/2001 | Watterson et al. |
| D452,338 | S | 12/2001 | Dalebout et al. |
| D453,543 | S | 2/2002 | Cutler |
| D453,948 | S | 2/2002 | Cutler |
| 6,350,218 | B1 | 2/2002 | Dalebout et al. |
| 6,387,020 | B1 | 5/2002 | Simonson |
| 6,413,191 | B1 | 7/2002 | Harris et al. |
| 6,422,980 | B1 | 7/2002 | Simonson |
| 6,447,424 | B1 | 9/2002 | Ashby et al. |
| 6,458,060 | B1 | 10/2002 | Watterson et al. |
| 6,458,061 | B2 | 10/2002 | Simonson |
| 6,471,622 | B1 | 10/2002 | Hammer et al. |
| 6,506,142 | B2 | 1/2003 | Itoh |
| 6,527,678 | B1 | 3/2003 | Wang |
| 6,547,698 | B2 | 4/2003 | Inagawa |
| 6,563,225 | B2 | 5/2003 | Soga et al. |
| 6,601,016 | B1 | 7/2003 | Brown et al. |
| 6,623,140 | B2 | 9/2003 | Watterson |
| 6,626,799 | B2 | 9/2003 | Watterson et al. |
| 6,652,424 | B2 | 11/2003 | Dalebout |
| 6,685,607 | B1 | 2/2004 | Olson |
| 6,695,581 | B2 | 2/2004 | Wasson et al. |
| 6,701,271 | B2 | 3/2004 | Willner et al. |
| 6,702,719 | B1 | 3/2004 | Brown et al. |
| 6,712,740 | B2 | 3/2004 | Simonson |
| 6,719,667 | B2 | 4/2004 | Wong |
| 6,730,002 | B2 | 5/2004 | Hald et al. |
| 6,743,153 | B2 | 6/2004 | Watterson et al. |
| 6,749,537 | B1 | 6/2004 | Hickman |
| 6,761,667 | B1 | 7/2004 | Cutler et al. |
| 6,770,015 | B2 | 8/2004 | Simonson |
| 6,783,482 | B2 | 8/2004 | Oglesby |
| 6,786,852 | B2 | 9/2004 | Watterson et al. |
| 6,796,925 | B2 | 9/2004 | Martinez |
| 6,808,472 | B1 | 10/2004 | Hickman |
| 6,821,230 | B2 | 11/2004 | Dalebout et al. |
| 6,830,540 | B2 | 12/2004 | Watterson |
| 6,863,641 | B1 | 3/2005 | Brown et al. |
| 6,866,613 | B1 | 3/2005 | Brown et al. |
| 6,875,160 | B2 | 4/2005 | Watterson et al. |
| 6,878,101 | B2 | 4/2005 | Colley |
| D507,311 | S | 7/2005 | Butler et al. |

(56) References Cited

U.S. PATENT DOCUMENTS 6,918,858 B2 7/2005 Watterson et al.
6,921,351 B1 7/2005 Hickman et al.
6,974,404 B1 12/2005 Watterson et al.
6,997,852 B2 2/2006 Watterson et al.
7,025,713 B2 4/2006 Dalebout
7,044,897 B2 5/2006 Myers et al.
7,052,442 B2 5/2006 Watterson
7,060,006 B1 6/2006 Watterson et al.
7,060,008 B2 6/2006 Watterson et al.
7,070,539 B2 7/2006 Brown et al.
7,070,542 B2 7/2006 Reyes
7,097,588 B2 8/2006 Watterson
D527,776 S 9/2006 Willardson et al.
7,112,168 B2 9/2006 Dalebout et al.
7,125,369 B2 10/2006 Endelman
7,128,693 B2 10/2006 Brown et al.
7,132,939 B2 11/2006 Tyndall
7,153,240 B1 12/2006 Wu
7,166,062 B1 1/2007 Watterson et al.
7,166,064 B2 1/2007 Watterson et al.
7,169,087 B2 1/2007 Ercanbrack et al.
7,169,093 B2 1/2007 Simonson et al.
7,172,536 B2 2/2007 Liu
7,192,387 B2 3/2007 Mendel
7,192,388 B2 3/2007 Dalebout et al.
7,250,022 B2 7/2007 Dalebout
7,282,016 B2 10/2007 Simonson
7,285,075 B2 10/2007 Cutler et al.
7,344,481 B2 3/2008 Watterson et al.
7,377,882 B2 5/2008 Watterson
7,425,188 B2 9/2008 Ercanbrack
7,429,236 B2 9/2008 Dalebout et al.
7,452,311 B2 11/2008 Barnes
7,455,622 B2 11/2008 Watterson et al.
7,470,219 B2 12/2008 Larson
7,482,050 B2 1/2009 Olson
D588,655 S 3/2009 Utykanski
7,510,509 B2 3/2009 Hickman
7,537,546 B2 5/2009 Watterson et al.
7,537,549 B2 5/2009 Nelson et al.
7,537,552 B2 5/2009 Dalebout et al.
7,549,947 B2 6/2009 Watterson et al.
7,556,590 B2 7/2009 Watterson et al.
7,563,203 B2 7/2009 Dalebout et al.
7,575,536 B1 8/2009 Hickman
7,578,771 B1 8/2009 Towley, III et al.
7,601,105 B1 10/2009 Gipson, III et al.
7,604,573 B2 10/2009 Dalebout et al.
D604,373 S 11/2009 Dalebout et al.
7,618,350 B2 11/2009 Dalebout et al.
7,618,357 B2 11/2009 Dalebout
7,625,315 B2 12/2009 Hickman
7,625,321 B2 12/2009 Simonson et al.
7,628,730 B1 12/2009 Watterson et al.
7,628,737 B2 12/2009 Kowallis et al.
7,637,847 B1 12/2009 Hickman
7,645,212 B2 1/2010 Ashby et al.
7,645,213 B2 1/2010 Watterson
7,658,698 B2 2/2010 Pacheco et al.
7,674,205 B2 3/2010 Dalebout et al.
7,713,171 B1 5/2010 Hickman
7,713,172 B2 5/2010 Watterson et al.
7,713,180 B2 5/2010 Wickens
7,717,828 B2 5/2010 Simonson et al.
7,736,279 B2 6/2010 Dalebout et al.
7,749,144 B2 7/2010 Hammer
7,766,797 B2 8/2010 Dalebout
7,771,320 B2 8/2010 Riley
7,771,329 B2 8/2010 Dalebout et al.
7,775,940 B2 8/2010 Dalebout et al.
7,789,800 B1 9/2010 Watterson et al.
7,798,946 B2 9/2010 Dalebout et al.
7,806,589 B2 10/2010 Tashman
7,815,548 B2 10/2010 Barre
7,815,550 B2 10/2010 Watterson et al.
7,857,731 B2 12/2010 Hickman et al.
7,862,475 B2 1/2011 Watterson
7,862,478 B2 1/2011 Watterson et al.
7,862,483 B2 1/2011 Hendrickson et al.
7,862,489 B2 1/2011 Savsek
7,887,470 B2 2/2011 Chen
D635,207 S 3/2011 Dalebout et al.
7,901,324 B2 3/2011 Kodama
7,901,330 B2 3/2011 Dalebout et al.
7,909,740 B2 3/2011 Dalebout et al.
7,980,996 B2 7/2011 Hickman
7,981,000 B2 7/2011 Watterson et al.
7,985,164 B2 7/2011 Ashby
8,007,409 B2 8/2011 Ellis
8,029,415 B2 10/2011 Ashby et al.
8,033,960 B1 10/2011 Dalebout et al.
D650,451 S 12/2011 Olson et al.
8,075,453 B1 12/2011 Wilkinson
D652,877 S 1/2012 Dalebout et al.
8,152,702 B2 4/2012 Pacheco
8,157,708 B2 4/2012 Daly
D659,775 S 5/2012 Olson et al.
D659,777 S 5/2012 Watterson et al.
D660,383 S 5/2012 Watterson et al.
D664,613 S 7/2012 Dalebout et al.
8,251,874 B2 8/2012 Ashby et al.
8,257,232 B2 9/2012 Albert
8,298,123 B2 10/2012 Hickman
8,298,125 B2 10/2012 Colledge et al.
D671,177 S 11/2012 Sip
D671,178 S 11/2012 Sip
8,308,618 B2 11/2012 Bayerlein
D673,626 S 1/2013 Olson et al.
8,608,624 B2 12/2013 Shabodyash
8,690,735 B2 4/2014 Watterson et al.
D707,763 S 6/2014 Cutler
8,740,753 B2 6/2014 Olson et al.
8,747,285 B2 6/2014 Hof
8,758,201 B2 6/2014 Ashby et al.
8,771,153 B2 7/2014 Dalebout et al.
8,784,270 B2 7/2014 Watterson
8,784,275 B2 7/2014 Mikan
8,784,278 B2 7/2014 Flake
8,808,148 B2 8/2014 Watterson
8,814,762 B2 8/2014 Butler
D712,493 S 9/2014 Ercanbrack et al.
8,840,075 B2 9/2014 Olson
8,845,493 B2 9/2014 Watterson et al.
8,870,726 B2 10/2014 Watterson et al.
8,876,668 B2 11/2014 Hendrickson et al.
8,894,549 B2 11/2014 Colledge
8,894,555 B2 11/2014 Olson
8,911,330 B2 12/2014 Watterson et al.
8,920,288 B2 12/2014 Dalebout
8,920,347 B2 12/2014 Bayerlein
8,979,709 B2 3/2015 Toback
8,986,165 B2 3/2015 Ashby
8,992,364 B2 3/2015 Law et al.
8,992,387 B2 3/2015 Watterson et al.
D726,476 S 4/2015 Ercanbrack
9,028,368 B2 5/2015 Ashby et al.
9,028,370 B2 5/2015 Watterson
9,039,578 B2 5/2015 Dalebout
D731,011 S 6/2015 Buchanan
9,072,930 B2 7/2015 Ashby et al.
9,119,983 B2 9/2015 Rhea
9,119,988 B2 9/2015 Murray
9,123,317 B2 9/2015 Watterson et al.
9,126,071 B2 9/2015 Smith
9,126,072 B2 9/2015 Watterson
9,138,615 B2 9/2015 Olson et al.
9,142,139 B2 9/2015 Watterson et al.
9,144,703 B2 9/2015 Dalebout et al.
9,149,683 B2 9/2015 Smith
9,186,535 B2 11/2015 Ercanbrack
9,186,549 B2 11/2015 Watterson et al.
9,186,552 B1 11/2015 Deal
9,227,101 B2 1/2016 Maguire
9,233,272 B2 1/2016 Villani

(56) References Cited

U.S. PATENT DOCUMENTS

| | | | |
|---|---|---|---|
| 9,254,416 | B2 | 2/2016 | Ashby |
| 9,278,248 | B2 | 3/2016 | Tyger |
| 9,278,249 | B2 | 3/2016 | Watterson |
| 9,278,250 | B2 | 3/2016 | Buchanan |
| 9,289,648 | B2 | 3/2016 | Watterson |
| 9,292,935 | B2 | 3/2016 | Koduri et al. |
| 9,308,417 | B2 | 4/2016 | Grundy |
| 9,339,683 | B2 | 5/2016 | Dilli |
| 9,339,691 | B2 | 5/2016 | Brammer |
| 9,352,185 | B2 | 5/2016 | Hendrickson et al. |
| 9,352,186 | B2 | 5/2016 | Watterson |
| 9,364,714 | B2 | 6/2016 | Koduri et al. |
| 9,375,605 | B2 | 6/2016 | Tyger |
| 9,378,336 | B2 | 6/2016 | Ohnemus |
| 9,381,394 | B2 | 7/2016 | Mortensen et al. |
| 9,387,387 | B2 | 7/2016 | Dalebout |
| 9,393,453 | B2 | 7/2016 | Watterson |
| 9,403,051 | B2 | 8/2016 | Cutler |
| 9,421,416 | B2 | 8/2016 | Mortensen et al. |
| 9,457,219 | B2 | 10/2016 | Smith |
| 9,457,220 | B2 | 10/2016 | Olson |
| 9,457,222 | B2 | 10/2016 | Dalebout |
| 9,460,632 | B2 | 10/2016 | Watterson |
| 9,463,356 | B2 | 10/2016 | Rhea |
| 9,468,794 | B2 | 10/2016 | Barton |
| 9,468,798 | B2 | 10/2016 | Dalebout |
| 9,480,874 | B2 | 11/2016 | Cutler |
| 9,492,704 | B2 | 11/2016 | Mortensen et al. |
| 9,498,668 | B2 | 11/2016 | Smith |
| 9,517,378 | B2 | 12/2016 | Ashby et al. |
| 9,521,901 | B2 | 12/2016 | Dalebout |
| 9,533,187 | B2 | 1/2017 | Dalebout |
| 9,539,461 | B2 | 1/2017 | Ercanbrack |
| 9,550,091 | B2 | 1/2017 | Emerson |
| 9,579,544 | B2 | 2/2017 | Watterson |
| 9,586,086 | B2 | 3/2017 | Dalebout et al. |
| 9,586,090 | B2 | 3/2017 | Watterson et al. |
| 9,604,099 | B2 | 3/2017 | Taylor |
| 9,616,278 | B2 | 4/2017 | Olson |
| 9,623,281 | B2 | 4/2017 | Hendrickson |
| 9,636,567 | B2 | 5/2017 | Brammer et al. |
| 9,675,839 | B2 | 6/2017 | Dalebout |
| 9,682,307 | B2 | 6/2017 | Dalebout |
| 9,694,234 | B2 | 7/2017 | Dalebout et al. |
| 9,694,242 | B2 | 7/2017 | Ashby |
| 9,737,755 | B2 | 8/2017 | Dalebout |
| 9,750,454 | B2 | 9/2017 | Walke |
| 9,764,186 | B2 | 9/2017 | Dalebout |
| 9,767,785 | B2 | 9/2017 | Ashby |
| 9,776,032 | B2 | 10/2017 | Moran |
| 9,795,822 | B2 | 10/2017 | Smith et al. |
| 9,795,855 | B2 | 10/2017 | Jafarifesharaki |
| 9,808,672 | B2 | 11/2017 | Dalebout |
| 9,849,326 | B2 | 12/2017 | Smith |
| 9,878,210 | B2 | 1/2018 | Watterson |
| 9,889,334 | B2 | 2/2018 | Ashby et al. |
| 9,889,339 | B2 | 2/2018 | Douglass |
| 9,919,183 | B1 | 3/2018 | Moschel |
| 9,937,376 | B2 | 4/2018 | McInelly et al. |
| 9,937,377 | B2 | 4/2018 | McInelly et al. |
| 9,937,378 | B2 | 4/2018 | Dalebout et al. |
| 9,937,379 | B2 | 4/2018 | Mortensen |
| 9,943,719 | B2 | 4/2018 | Smith et al. |
| 9,943,722 | B2 | 4/2018 | Dalebout |
| 9,948,037 | B2 | 4/2018 | Ashby |
| 9,968,821 | B2 | 5/2018 | Finlayson et al. |
| 9,968,823 | B2 | 5/2018 | Cutler |
| 9,980,465 | B2 | 5/2018 | Hayashi |
| 10,010,755 | B2 | 7/2018 | Watterson |
| 10,010,756 | B2 | 7/2018 | Watterson |
| 10,029,145 | B2 | 7/2018 | Douglass |
| D826,350 | S | 8/2018 | Hochstrasser |
| 10,046,196 | B2 | 8/2018 | Ercanbrack |
| D827,733 | S | 9/2018 | Hochstrasser |
| 10,065,064 | B2 | 9/2018 | Smith et al. |
| 10,071,285 | B2 | 9/2018 | Smith et al. |
| 10,085,586 | B2 | 10/2018 | Smith et al. |
| 10,086,254 | B2 | 10/2018 | Watterson |
| 10,118,064 | B1 | 11/2018 | Cox |
| 10,136,842 | B2 | 11/2018 | Ashby |
| 10,186,161 | B2 | 1/2019 | Watterson |
| 10,207,143 | B2 | 2/2019 | Dalebout |
| 10,207,145 | B2 | 2/2019 | Tyger |
| 10,207,147 | B2 | 2/2019 | Ercanbrack |
| 10,207,148 | B2 | 2/2019 | Powell |
| 10,212,994 | B2 | 2/2019 | Watterson |
| 10,220,259 | B2 | 3/2019 | Brammer |
| 10,226,396 | B2 | 3/2019 | Ashby |
| 10,226,664 | B2 | 3/2019 | Dalebout |
| 10,252,109 | B2 | 4/2019 | Watterson |
| 10,272,317 | B2 | 4/2019 | Watterson |
| D852,292 | S | 6/2019 | Cutler |
| 10,343,017 | B2 | 7/2019 | Jackson |
| 10,376,736 | B2 | 8/2019 | Powell et al. |
| D864,320 | S | 10/2019 | Weston |
| D864,321 | S | 10/2019 | Weston |
| 10,449,416 | B2 | 10/2019 | Dalebout |
| 2002/0016235 | A1 | 2/2002 | Ashby et al. |
| 2002/0077221 | A1 | 6/2002 | Dalebout et al. |
| 2002/0128127 | A1 | 9/2002 | Chen |
| 2002/0159253 | A1 | 10/2002 | Dalebout et al. |
| 2003/0171189 | A1 | 9/2003 | Kaufman |
| 2004/0091307 | A1 | 5/2004 | James |
| 2004/0127335 | A1 | 7/2004 | Watterson et al. |
| 2004/0171464 | A1 | 9/2004 | Ashby et al. |
| 2004/0171465 | A1 | 9/2004 | Hald et al. |
| 2005/0049123 | A1 | 3/2005 | Dalebout et al. |
| 2005/0077805 | A1 | 4/2005 | Dalebout et al. |
| 2005/0107229 | A1 | 5/2005 | Wickens |
| 2005/0164839 | A1 | 7/2005 | Watterson et al. |
| 2005/0272577 | A1 | 12/2005 | Olson et al. |
| 2005/0277520 | A1 | 12/2005 | Van Waes |
| 2006/0135322 | A1 | 6/2006 | Rocker |
| 2006/0217237 | A1 | 9/2006 | Rhodes |
| 2006/0240959 | A1 | 10/2006 | Huang |
| 2007/0066448 | A1 | 3/2007 | Pan |
| 2007/0117683 | A1 | 5/2007 | Ercanbrack et al. |
| 2007/0197353 | A1 | 8/2007 | Hundley |
| 2007/0254778 | A1 | 11/2007 | Ashby |
| 2008/0242520 | A1 | 10/2008 | Hubbard |
| 2008/0300110 | A1 | 12/2008 | Smith et al. |
| 2009/0105052 | A1 | 4/2009 | Dalebout et al. |
| 2010/0242246 | A1 | 9/2010 | Dalebout et al. |
| 2010/0317488 | A1 | 12/2010 | Cartaya |
| 2011/0131005 | A1 | 6/2011 | Ueshima |
| 2012/0237911 | A1 | 9/2012 | Watterson |
| 2012/0295774 | A1 | 11/2012 | Dalebout et al. |
| 2013/0014321 | A1 | 1/2013 | Sullivan |
| 2013/0123083 | A1 | 5/2013 | Sip |
| 2013/0165195 | A1 | 6/2013 | Watterson |
| 2013/0172152 | A1 | 7/2013 | Watterson |
| 2013/0172153 | A1 | 7/2013 | Watterson |
| 2013/0178334 | A1 | 7/2013 | Brammer |
| 2013/0178768 | A1 | 7/2013 | Dalebout |
| 2013/0190136 | A1 | 7/2013 | Watterson |
| 2013/0196298 | A1 | 8/2013 | Watterson |
| 2013/0196822 | A1 | 8/2013 | Watterson et al. |
| 2013/0218585 | A1 | 8/2013 | Watterson |
| 2013/0244836 | A1 | 9/2013 | Maughan |
| 2013/0267383 | A1 | 10/2013 | Watterson |
| 2013/0268101 | A1 | 10/2013 | Brammer |
| 2013/0274067 | A1 | 10/2013 | Watterson et al. |
| 2013/0281241 | A1 | 10/2013 | Watterson |
| 2014/0024499 | A1 | 1/2014 | Watterson |
| 2014/0073970 | A1 | 3/2014 | Ashby |
| 2014/0121071 | A1 | 5/2014 | Strom et al. |
| 2014/0135173 | A1 | 5/2014 | Watterson |
| 2014/0274574 | A1 | 9/2014 | Shorten et al. |
| 2014/0274579 | A1 | 9/2014 | Olson |
| 2014/0287884 | A1 | 9/2014 | Buchanan |
| 2014/0309085 | A1 | 10/2014 | Watterson et al. |
| 2015/0182781 | A1 | 7/2015 | Watterson |
| 2015/0238817 | A1 | 8/2015 | Watterson |
| 2015/0250418 | A1 | 9/2015 | Ashby |

(56) References Cited

U.S. PATENT DOCUMENTS

| | | | |
|---|---|---|---|
| 2015/0251055 | A1 | 9/2015 | Ashby |
| 2015/0253210 | A1 | 9/2015 | Ashby et al. |
| 2015/0253735 | A1 | 9/2015 | Watterson |
| 2015/0253736 | A1 | 9/2015 | Watterson |
| 2015/0258560 | A1 | 9/2015 | Ashby |
| 2015/0367161 | A1 | 12/2015 | Wiegardt |
| 2016/0058335 | A1 | 3/2016 | Ashby |
| 2016/0059064 | A1 | 3/2016 | Smith et al. |
| 2016/0063615 | A1 | 3/2016 | Watterson |
| 2016/0092909 | A1 | 3/2016 | Watterson |
| 2016/0101311 | A1 | 4/2016 | Workman |
| 2016/0107065 | A1 | 4/2016 | Brammer |
| 2016/0121074 | A1 | 5/2016 | Ashby |
| 2016/0148535 | A1 | 5/2016 | Ashby |
| 2016/0148536 | A1 | 5/2016 | Ashby |
| 2016/0158595 | A1 | 6/2016 | Dalebout |
| 2016/0206248 | A1 | 7/2016 | Sartor et al. |
| 2016/0206922 | A1 | 7/2016 | Dalebout et al. |
| 2016/0250519 | A1 | 9/2016 | Watterson |
| 2016/0253918 | A1 | 9/2016 | Watterson |
| 2016/0339298 | A1 | 11/2016 | Kats |
| 2016/0346595 | A1 | 12/2016 | Dalebout et al. |
| 2016/0346617 | A1 | 12/2016 | Srugo et al. |
| 2017/0036053 | A1 | 2/2017 | Smith et al. |
| 2017/0056711 | A1 | 3/2017 | Dalebout et al. |
| 2017/0056715 | A1 | 3/2017 | Dalebout et al. |
| 2017/0056726 | A1 | 3/2017 | Dalebout et al. |
| 2017/0124912 | A1 | 5/2017 | Ashby et al. |
| 2017/0193578 | A1 | 7/2017 | Watterson |
| 2017/0266483 | A1 | 9/2017 | Dalebout et al. |
| 2017/0266489 | A1 | 9/2017 | Douglass et al. |
| 2017/0266532 | A1 | 9/2017 | Watterson |
| 2017/0270820 | A1 | 9/2017 | Ashby |
| 2018/0001135 | A1 | 1/2018 | Powell |
| 2018/0036585 | A1 | 2/2018 | Powell |
| 2018/0084817 | A1 | 3/2018 | Capell et al. |
| 2018/0085630 | A1 | 3/2018 | Capell et al. |
| 2018/0089396 | A1 | 3/2018 | Capell et al. |
| 2018/0099116 | A1 | 4/2018 | Ashby |
| 2018/0099179 | A1 | 4/2018 | Chatterton et al. |
| 2018/0099180 | A1 | 4/2018 | Wilkinson |
| 2018/0099205 | A1 | 4/2018 | Watterson |
| 2018/0111034 | A1 | 4/2018 | Watterson |
| 2018/0117383 | A1 | 5/2018 | Workman |
| 2018/0117385 | A1 | 5/2018 | Watterson et al. |
| 2018/0117393 | A1 | 5/2018 | Ercanbrack |
| 2018/0154207 | A1 | 6/2018 | Hochstrasser |
| 2018/0154208 | A1 | 6/2018 | Powell et al. |
| 2018/0200566 | A1 | 7/2018 | Weston |
| 2019/0058370 | A1 | 2/2019 | Tinney |
| 2019/0080624 | A1 | 3/2019 | Watterson |
| 2019/0168072 | A1 | 6/2019 | Brammer |
| 2019/0178313 | A1 | 6/2019 | Wrobel |
| 2019/0192898 | A1 | 6/2019 | Dalebout |
| 2019/0192952 | A1 | 6/2019 | Powell |
| 2019/0209893 | A1 | 7/2019 | Watterson |
| 2019/0223612 | A1 | 7/2019 | Watterson |
| 2019/0269971 | A1 | 9/2019 | Capell et al. |
| 2019/0275366 | A1 | 9/2019 | Powell |
| 2019/0282852 | A1 | 9/2019 | Dalebout |
| 2019/0328079 | A1 | 10/2019 | Ashby et al. |
| 2019/0329091 | A1 | 10/2019 | Powell et al. |

FOREIGN PATENT DOCUMENTS

| | | |
|---|---|---|
| KR | 100829774 | 5/2018 |
| TW | I339127 | 8/2008 |
| TW | M422981 | 2/2012 |
| TW | M504568 | 3/2015 |
| WO | 2000030717 | 6/2000 |
| WO | 2009014330 | 1/2009 |

OTHER PUBLICATIONS

U.S. Appl. No. 29/702,127, filed Sep. 16, 2019, ICON Health & Fitness, Inc.

U.S. Appl. No. 13/088,007, filed Apr. 15, 2011, Scott R. Watterson.

U.S. Appl. No. 15/821,386, filed Nov. 22, 2017, ICON Health & Fitness, Inc.

U.S. Appl. No. 15/973,176, filed May 7, 2018, Melanie Douglass.

U.S. Appl. No. 16/378,022, filed Apr. 8, 2019, William T. Dalebout.

U.S. Appl. No. 16/435,104, filed Jun. 7, 2019, Dale Alan Buchanan.

U.S. Appl. No. 16/506,085, filed Jul. 9, 2019, ICON Health & Fitness, Inc.

U.S. Appl. No. 62/697,833, filed Jul. 13, 2018, ICON Health & Fitness, Inc.

U.S. Appl. No. 62/796,952, filed Jan. 25, 2019, ICON Health & Fitness, Inc.

U.S. Appl. No. 62/804,146, filed Feb. 11, 2019, ICON Health & Fitness, Inc.

U.S. Appl. No. 62/804,685, filed Feb. 12, 2019, ICON Health & Fitness, Inc.

U.S. Appl. No. 62/852,118, filed May 22, 2019, David Hays.

U.S. Appl. No. 62/866,576, filed Jun. 25, 2019, ICON Health & Fitness, Inc.

U.S. Appl. No. 62/887,391, filed Aug. 15, 2019, ICON Health & Fitness, Inc.

U.S. Appl. No. 62/887,398, filed Aug. 15, 2019, ICON Health & Fitness, Inc.

U.S. Appl. No. 62/897,113, filed Sep. 9, 2019, ICON Health & Fitness, Inc.

U.S. Appl. No. 62/842,118, filed May 23, 2019, ICON Health & Fitness, Inc.

English Translation of Search Report for Taiwan Patent Application No. 104131458 dated Jun. 3, 2016.

English Translation of Search Report for Taiwan Patent Application No. 105126694 dated Oct. 3, 2017.

International Search Report and Written Opinion issued in PCT/US2016/048692 dated Dec. 1, 2016.

International Search Report and Written Opinion issued in PCT/US2017/023002 dated Jun. 28, 2017.

International Search Report and Written Opinion issued in PCT/US2017/022989 dated May 23, 2017.

U.S. Appl. No. 62/310,503, filed Mar. 18, 2016, titled "Coorrdinated Weight Selection".

Octane Fitness; "Consumer Adapter Kit for Cross Circuit Pro—Safety and Assembly Instructions"; Instruction Manual; 2011; 4 pages; located at: https://www.octanefitness.com/home/wp-content/uploads/sites/2/2014/01/106082-001-REV-A-INSTRUCTIONS-CONSUMER-ADAPTER-FOR-CCPRO-2.22.11.pdf.

Octane Fitness; Cross Circuit Pro Kit-XT One Assembly & Set-Up Instructions; Instruction Manual; 2016; 20 pages; located at: https://www.octanefitness.com/wp-content/uploads/2016/11/110786-001-REV-C-INSTRUCTIONS-CROSS-CIRCUIT-PRO-XT-ONE-UnR.pdf.

Octane Fitness; Product Programs and Features; Instruction Manual; 2017; 56 pages; located at: https://www.octanefitness.com/home/wp-content/uploads/sites/2/2017/04/110751-001-REV-E-PROGRAMS-FEATURES-COMM-ENG.pdf.

Octane Fitness; Octane Fitness Cross Circuit; Webpage; accessed on Nov. 30, 2018; located at: https://www.octanefitness.com/commercial/cross-circuit/.

EXERCISE SYSTEM INCLUDING A STATIONARY BICYCLE AND A FREE WEIGHT CRADLE

RELATED APPLICATIONS

This application is a continuation of U.S. patent application Ser. No. 16/299,668 filed Mar. 12, 2019, which is a continuation of U.S. patent application Ser. No. 15/461,040 filed Mar. 16, 2017, which claims priority to U.S. Patent Application Ser. No. 62/310,503 filed on Mar. 18, 2016, which applications are herein incorporated by reference for all that they disclose.

BACKGROUND

While numerous exercise activities exist that one may participate in, exercise may be broadly broken into the categories of aerobic exercise and anaerobic exercise. Aerobic exercise generally refers to activities that substantially increase the heart rate and respiration of the exerciser for an extended period of time. This type of exercise is generally directed to enhancing cardiovascular performance. These exercises usually include low or moderate resistance to the movement of the individual. For example, aerobic exercise includes activities such as walking, running, jogging, swimming, or bicycling for extended distances and extended periods of time.

Anaerobic exercise generally refers to exercise that strengthens skeletal muscles and usually involves the flexing or contraction of targeted muscles through significant exertion during a relatively short period of time and/or through a relatively small number of repetitions. For example, anaerobic exercise includes activities such as weight training, push-ups, sit-ups, pull-ups, or a series of short sprints.

To build skeletal muscle, a muscle group is contracted against resistance. The contraction of some muscle groups produces a pushing motion, while the contraction of other muscle groups produces a pulling motion. One type of exercise device that provides resistance to user's muscle contraction is a dumbbell. A dumbbell often includes a handle and weights at either end of the handle. In some cases, the weights are permanently affixed to the handle. Other types of dumbbells are adjustable where the weights can be removed and/or added to allow the user to adjust the amount of weight on the dumbbell.

One type of dumbbell is disclosed in U.S. Pat. No. 7,172,536 issued to Wei Ming Liu. In this reference, an adjustable dumbbell includes a number of weights each having a slot to receive end portions of a bar, and a number of latch rods slidably engaged in the weights and each having an inner end engageable into the slots of the weights and engageable with the bar, to anchor and latch a selected number of the weights to the bar, and to allow the selected weights to be moved in concert with the bar. The weights each have a spring member to bias and force the inner end of the latch rod to engage with and to latch the weights to the bar. The weights each include a panel having an orifice to slidably receive the latch rod, and to anchor the latch rod to the panel when the catch of the knob is rotated relative to the panel. Other types of dumbbells are described in U.S. Pat. No. 6,500,101 issued to James Chen, U.S. Patent Publication No. 2004/0005968 issued to Douglas A. Crawford, et al., U.S. Patent Publication No. 2012/0115689 issued to William Dalebout, et al., and WIPO International Publication No. WO/1994/017862 issued to Carl K. Towley. Each of these documents are herein incorporated by reference for all that they contain.

SUMMARY

In one embodiment, an exercise system includes a stationary bicycle, a free weight cradle incorporated into the stationary bicycle, pedals incorporated into the stationary bicycle, a display, one or more processors, and memory. The free weight cradle is configured to hold one or more free weights that are removable from the free weight cradle. The pedals are configured to be movable with respect to the free weight cradle during execution of a programmed workout. The memory stores programmed instructions of the programmed workout that, when executed by the one or more processors, cause the one or more processors to: automatically alternate, by the programmed instructions of the programmed workout, between biking portions of the programmed workout and lifting portions of the programmed workout; automatically control, by the programmed instructions of the programmed workout, a resistance level of the pedals during the biking portions of the programmed workout; and automatically present, by the programmed instructions of the programmed workout, lifting instructions on the display, the lifting instructions configured to instruct a user on lifting the one or more free weights during the lifting portions of the programmed workout.

In one embodiment, a free weight assembly includes a cradle, at least one free weight removable from the cradle, an aerobic exercise element that is movable with respect to the cradle during the performance of an exercise, an input in communication with a processor that determines a time to instruct a user to remove the free weight, and an indicator that activates when the time to remove the free weight arrives.

The indicator may be incorporated into the free weight.

The indicator may be incorporated into the cradle.

The assembly may include an adjustable dumbbell connected to the free weight where the indicator is incorporated into the adjustable dumbbell.

The adjustable dumbbell may select a weight amount for the user to lift before the time arrives.

The indicator may also indicate a weight amount to lift.

The indicator may include a light that illuminates when the time arrives.

The indicator may include a speaker that broadcasts audio commands to remove the free weight when the time arrives.

The free weight assembly may be incorporated into a treadmill.

The indicator may be coordinated with an exercise program.

The exercise program may include an anaerobic portion and an aerobic portion.

The assembly may include a second indicator that instructs the user to perform a specific exercise with the at least one free weight.

The indicator may include a display.

The assembly may include a transmitter in communication with the input.

The transmitter may be in communication with an activity tracker.

In one embodiment, a free weight assembly includes a cradle, at least one free weight removable from the cradle, an aerobic exercise element that is movable with respect to the cradle during the performance of an exercise, an input in communication with a processor that determines a time to instruct a user to remove the free weight, an adjustable dumbbell connected to the free weight, an indicator that activates when the time to remove the free weight arrives, and a transmitter in communication with the input and an activity tracker.

The adjustable dumbbell may select a weight amount for the user to lift before the time arrives.

The indicator may include a light that illuminates when the time arrives.

The free weight assembly may be incorporated into a treadmill.

In one embodiment, an exercise apparatus includes a treadmill, a free weight assembly incorporated into the treadmill. The free weight assembly includes a cradle, at least one free weight removable from the cradle, an input in communication with a processor that determines a time to instruct a user to remove the free weight, an adjustable dumbbell connected to the free weight, the adjustable dumbbell selects a weight amount for the user to lift before the time arrives, a light that illuminates when the time to remove the free weight arrives, and a transmitter in communication with the input and an activity tracker.

BRIEF DESCRIPTION OF THE DRAWINGS

The accompanying drawings illustrate various embodiments of the present apparatus and are a part of the specification. The illustrated embodiments are merely examples of the present apparatus and do not limit the scope thereof.

Throughout the drawings, identical reference numbers designate similar, but not necessarily identical, elements.

DETAILED DESCRIPTION

For purposes of this disclosure, the term "aligned" means parallel, substantially parallel, or forming an angle of less than 35.0 degrees. For purposes of this disclosure, the term "transverse" means perpendicular, substantially perpendicular, or forming an angle between 55.0 and 125.0 degrees. Also, for purposes of this disclosure, the term "length" means the longest dimension of an object. Also, for purposes of this disclosure, the term "width" means the dimension of an object from side to side. For the purposes of this disclosure, the term "above" generally means superjacent, substantially superjacent, or higher than another object although not directly overlying the object. Further, for purposes of this disclosure, the term "mechanical communication" generally refers to components being in direct physical contact with each other or being in indirect physical contact with each other where movement of one component affect the position of the other.

Figure 1:
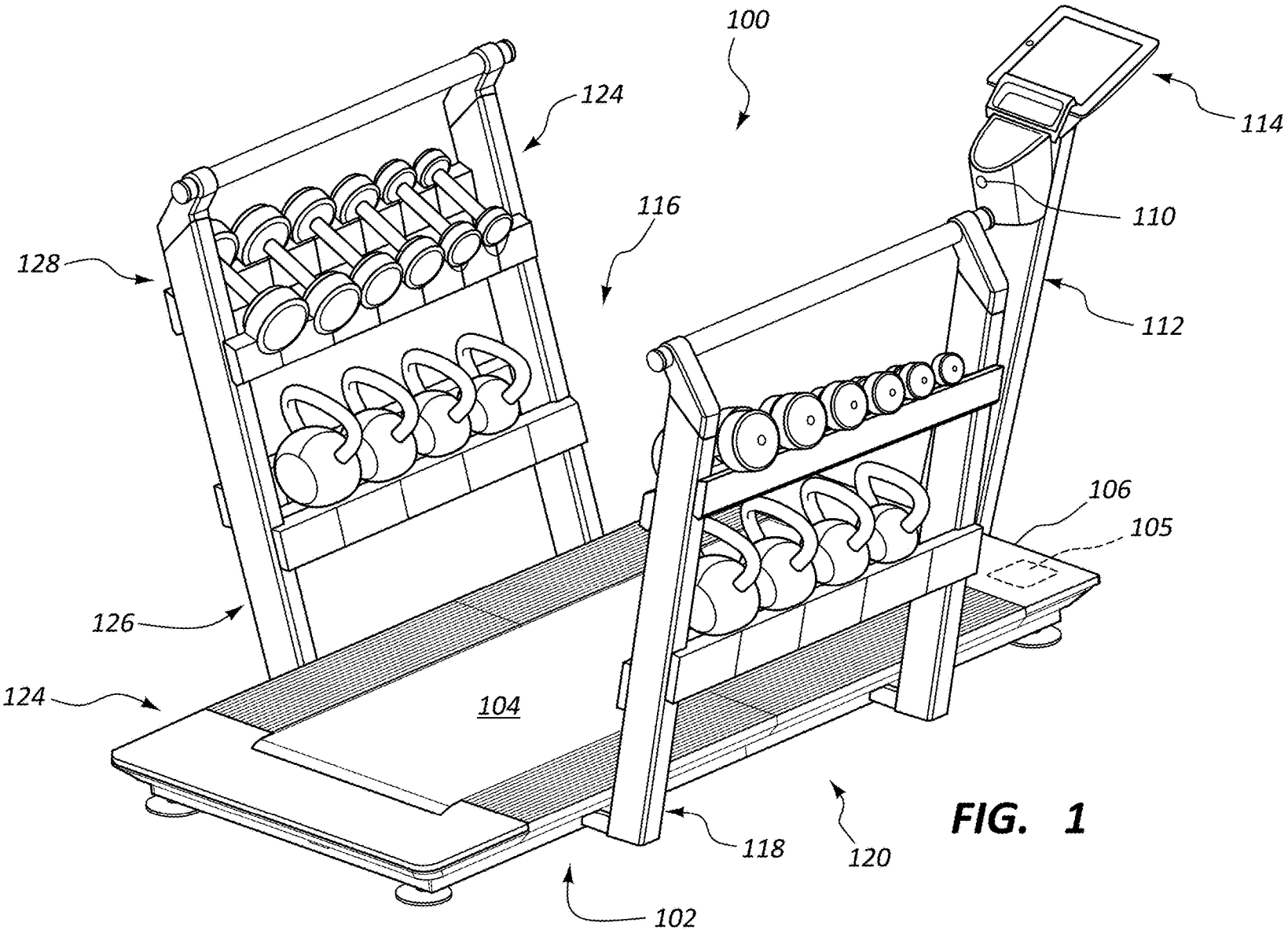
FIG. 1 illustrates a perspective view of an example of a treadmill in accordance with the present disclosure.

FIG. 1 depicts an example of a treadmill 100 having a deck 102 with a first pulley disposed in a first portion of the deck 102 and a second pulley incorporated into a second portion of the deck 102. A tread belt 104 surrounds the first pulley and the second pulley. A motor 105 is in mechanical communication with either the first pulley or the second pulley. A cover 106 is superjacent the motor 105. A repetition counter 110 is also incorporated into the treadmill. The treadmill 100 includes an upright portion 112 that supports a console 114. In this example, the repetition counter 110 is incorporated into the upright portion 112.

Also incorporated into the treadmill 100 is a free weight cradle 120. In this example, a first portion 118 of the free weight cradle 120 is connected to a first side 116 of the deck 102, and a second portion 122 of the free weight cradle 120 is connected to a second side 124 of the deck 102. The free weight cradle 120 may include multiple tiers. In this example, each of the portions of the free weight cradle include a first tier 126 and a second tier 128. In some cases, each of the tiers includes a cross member that includes features that prevent the free weights from slipping off of the rack. For example, the feature may include a lip, a recess, another type of feature, or combinations thereof.

Figure 2:
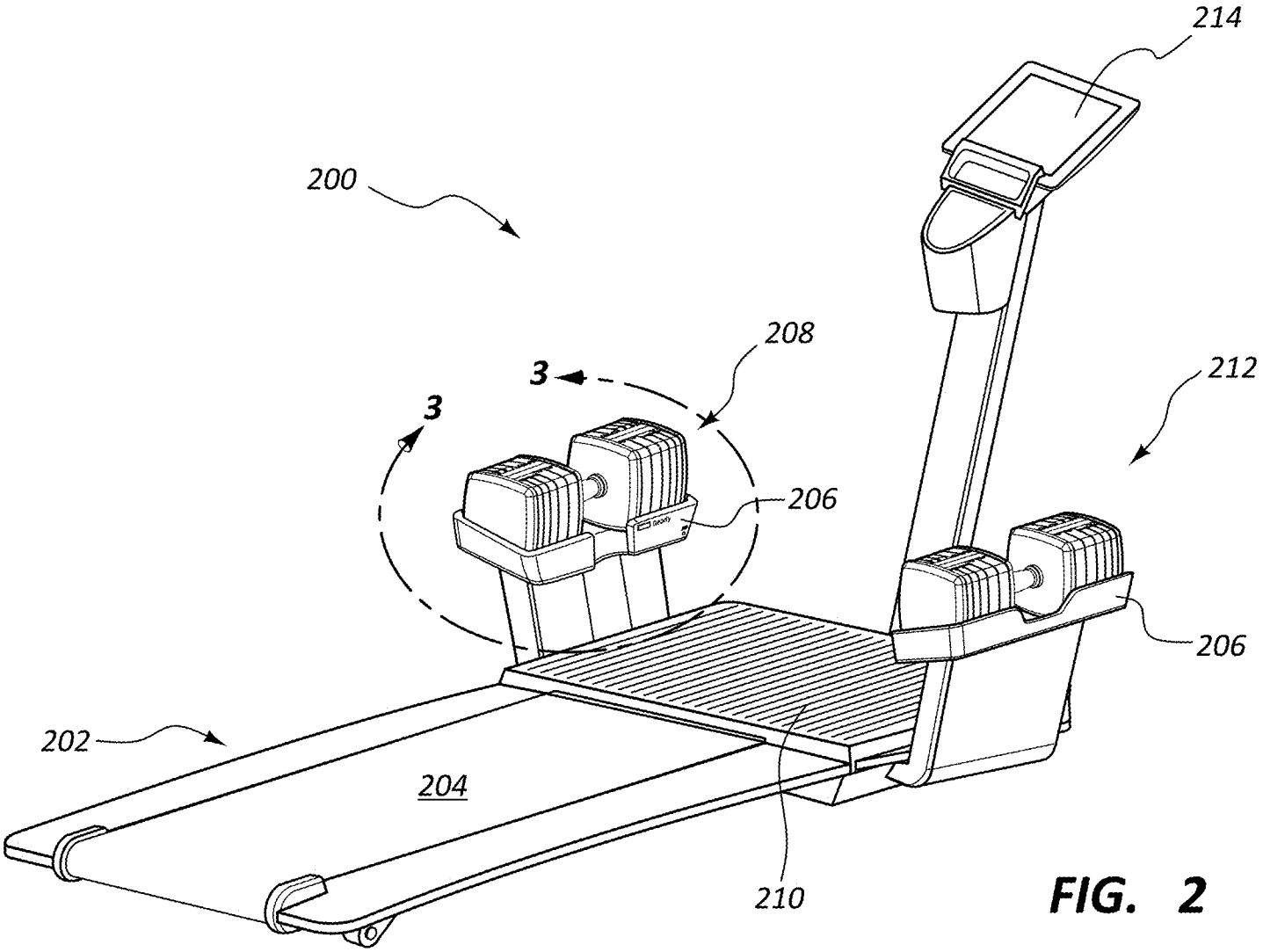
FIG. 2 illustrates a perspective view of an example of a treadmill in accordance with the present disclosure.

FIG. 2 depicts an example of a treadmill 200. In this example, the treadmill 200 includes a deck 202, and with a tread belt 204 that surrounds a first pulley and second pulley incorporated into the deck 202. A free weight cradle 206 is also incorporated into the treadmill 200. In this example, the free weight cradle 206 includes just a single tier and supports an adjustable dumbbell 208.

A weight scale 210 is incorporated into the deck 202 at a front end 212 of the treadmill 200. In this example, the weight scale 210 is positioned over the motor that drives the first pulley and therefore drives the tread belt 204. As a user stands on the weight scale 210, the weight of the user can be presented in the console 214, in a display incorporated into the weight scale 210, to a mobile device or other computing device in communication with the weight scale, or combinations thereof. Additionally, when the user lifts the free weights off of the cradle 206, the weight scale measures the combined weight of the user and the free weights. In some cases, the fluctuation of the weight scale's measurements that occur as the user performs an anaerobic exercise with the free weights is used by the repetition counter to determine how many lifts the user has performed.

Figure 3:
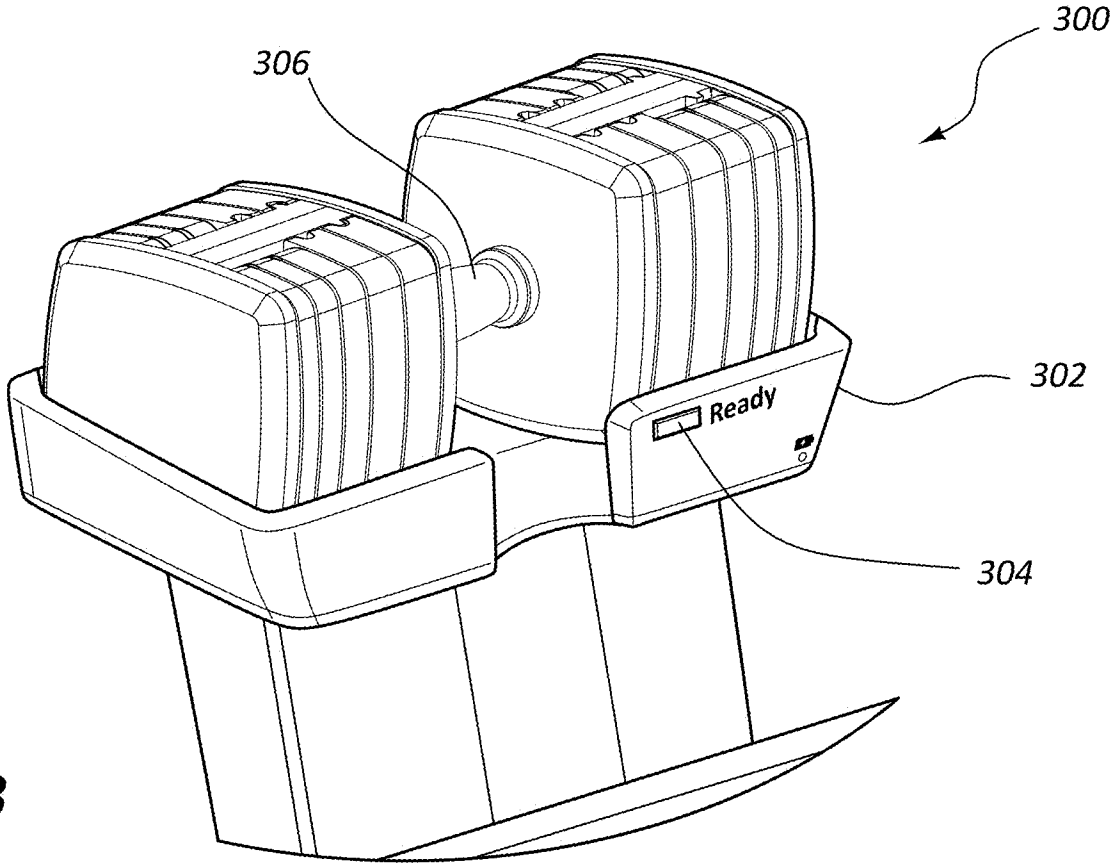
FIG. 3 illustrates a perspective view of an example of an adjustable dumbbell and a cradle in accordance with the present disclosure.

FIG. 3 depicts an adjustable dumbbell 300. In this example, the adjustable dumbbell is positioned in a cradle 302. The cradle 302 includes an indicator 304 that communicates to the user that it is time to pick up the adjustable dumbbell 300. In this example, the indicator 304 includes a light. In this example, the light can illuminate when the proper amount of weight has been mechanically connected to the handle 306 of the adjustable dumbbell. For example, the free weights positioned in the cradle and/or free weight cradle may include a fixed dumbbell, a kettle weight, a bar bell, another type of weight, or combinations thereof. The indicator 304 may indicate to the user when it is time to pick up the free weight. In some cases, multiple indicators are incorporated into a cradle and are associated with a different weight amount. For example, the cradle may include a position for a 10 pound free weight, a 15 pound free weight, and 20 pound free weight. A first indicator may correspond to the 10 pound weight, a second indicator may correspond to the 15 pound weight, and a third indicator may correspond with the 20 pound weight. When it is time for the user to use the 10 pound weight, the light of the first indicator may illuminate. Likewise, when it is time for the user to use the 20 pound weight, the light of the third indicator may illuminate.

In other examples, the free weight is another type of weight other than an adjustable dumbbell. The cradle may be any appropriate type of cradle. In some examples, the cradle includes a recess that is sized to the dimensions of the free weight intended to be located into that spot in the cradle. In other examples, the cradle may include a shelf that can accommodate free weights of varying size and dimensions.

Figure 4:
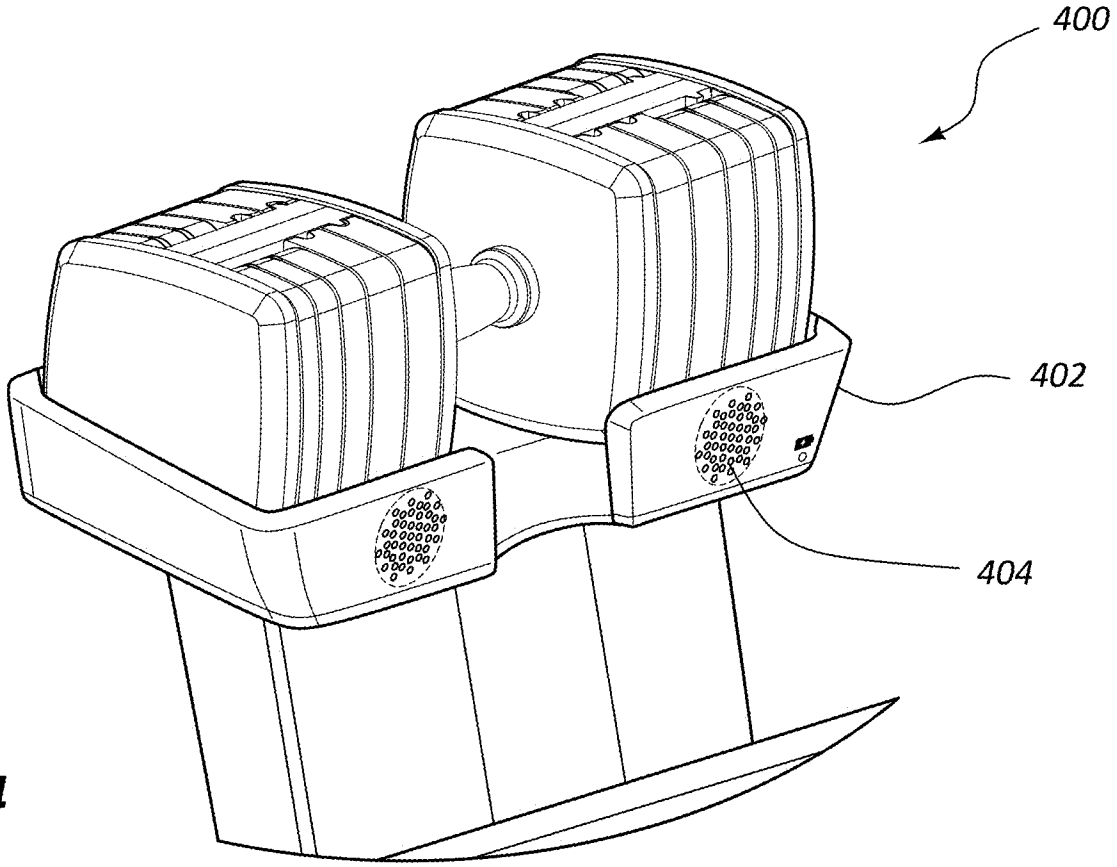
FIG. 4 illustrates a perspective view of an example of an adjustable dumbbell and a cradle in accordance with the present disclosure.

FIG. 4 depicts an adjustable dumbbell 400. In this example, the adjustable dumbbell is positioned in a cradle 402. The cradle 402 includes an indicator 404 that communicates to the user that it is time to pick up the adjustable dumbbell 400. In this example, the indicator 404 includes a speaker.

Figure 5:
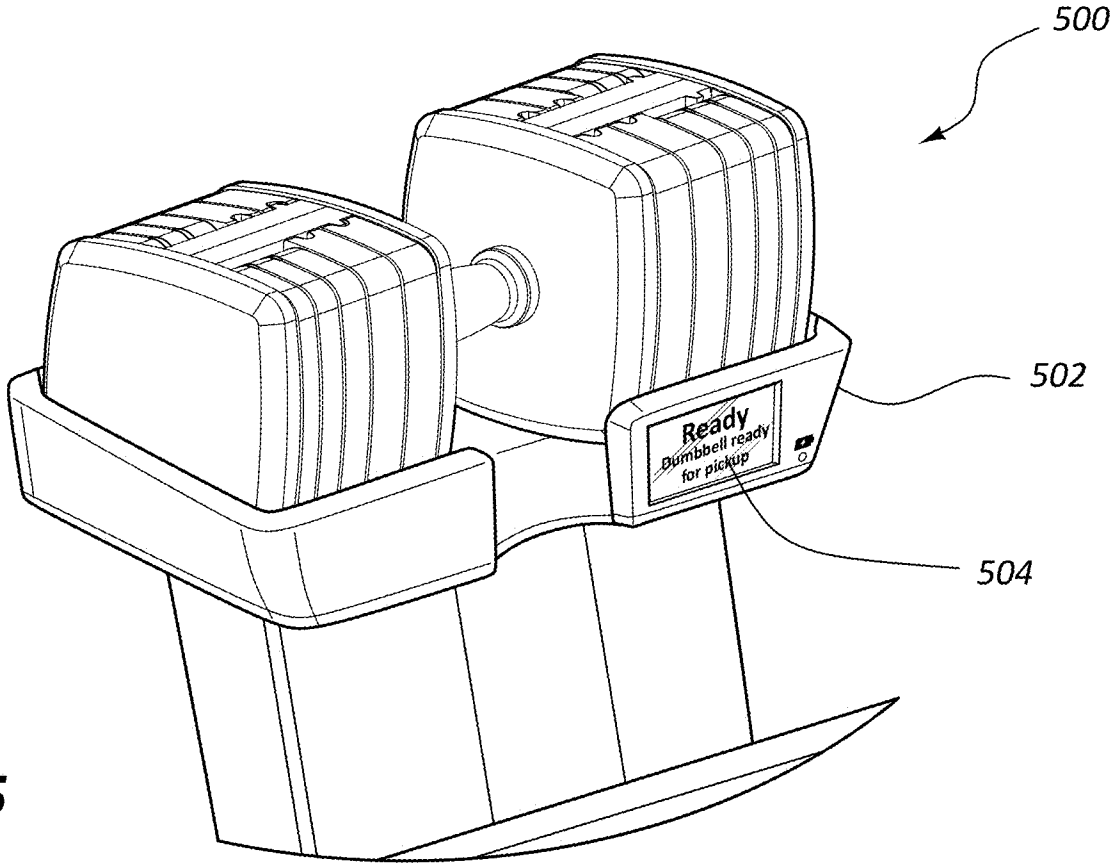
FIG. 5 illustrates a perspective view of an example of an adjustable dumbbell and a cradle in accordance with the present disclosure.

FIG. 5 depicts an adjustable dumbbell 500. In this example, the adjustable dumbbell is positioned in a cradle 502. The cradle 502 includes an indicator 504 that communicates to the user when the time to pick up the adjustable dumbbell 500 has arrived. In this example, the indicator 504 includes a display. In this example, the display indicates that it is time for the user to use the adjustable dumbbell 500 by presenting written words the display's screen. In other examples, the display may indicate to the user that it is time to use the weights by presenting an image related to lifting the weights. In yet another example, the display may indicate which amount of weight to lift, the type of lift to perform, the number of repetitions to do with each lift, safety precautions about each lift, other information, or combinations thereof.

The indicator may be connected to any appropriate portion of the free weight assembly. For example, the indicator can be connected to the adjustable dumbbell, a weight plate, another kind of free weight, the cradle, a cradle stand, other portion of the free weight assembly, or combinations thereof.

Figure 6:
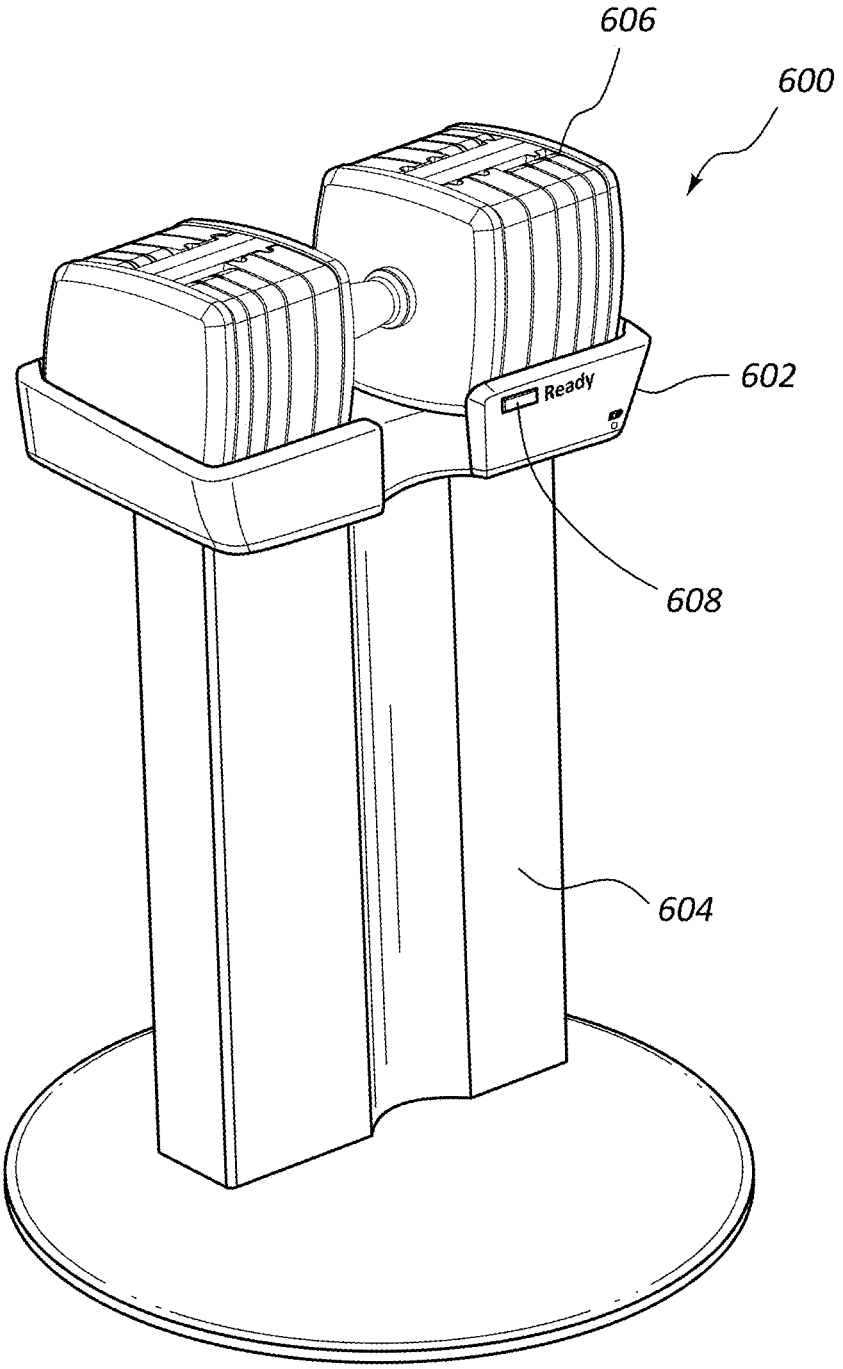
FIG. 6 illustrates a perspective view of an example of an adjustable dumbbell and a cradle in accordance with the present disclosure.

FIG. 6 depicts an example of a free weight assembly 600. In this example, a cradle 602 is supported on a stand 604. An adjustable dumbbell 606 is positioned in the cradle 602. An indicator 608 that indicates when the time has arrived to lift the adjustable dumbbell 606 out of the cradle 602 is incorporated into the cradle 602. In other examples, the indicator 608 is incorporated into the stand 604.

Figure 7:
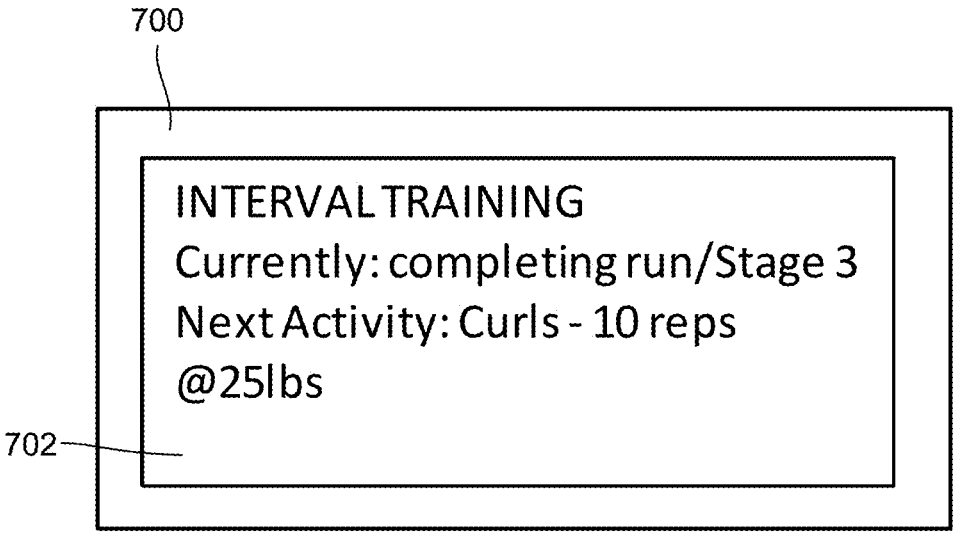
FIG. 7 depicts an example of a display incorporated into a free weight assembly.

FIG. 7 depicts an example of a display 700 incorporated into a free weight assembly. In this example, the display 700 includes a screen 702 that depicts exercise instructions to the user. The instructions provide details about the exercise activity that the user is instructed to currently be executing. In this example, the current activity is a running activity. The instructions also include the activity that the user will be instructed to execute after completing the current activity. In this example, the upcoming activity is a lifting activity.

General Description

In general, the invention disclosed herein may provide a user with a free weight assembly that can instruct the user on when to perform a lift with the free weights of the assembly. In some examples, the invention provides the user with a weight amount indication of what the user is to lift. An example of this aspect of the invention may include when a cradle of the assembly holds multiple free weights with varying amounts of mass. Different indicators incorporated into the assembly can indicate to the user when to pick up the different free weights by activating just those indicators that are associated with the intended free weights.

The free weight assembly may be part of an exercise machine that includes both aerobic and anaerobic components. For example, the exercise machine may include, in addition to the free weights, an aerobic exercise element that is movable with respect to the free weight's cradle during the performance of an exercise. In some cases, the aerobic exercise element is a tread belt, a pedal, a pull cable, another type of aerobic exercise element, or combinations thereof. In these situations, the free weight cradle may be incorporated into a treadmill, an elliptical trainer, a stepper machine, a stationary bicycle, a rowing machine, another type of exercise machine with an aerobic exercise component, or combinations thereof. In some cases, a display instructing the user to perform activities with the exercise machine may instruct the user to use the aerobic exercise element for anaerobic activities. For example, interval training with pedals or a tread belt is considered to be an anaerobic activity and the program can instruct the user to use the aerobic exercise element for both types of activities.

In some cases, a free weight assembly is incorporated into a treadmill or another type of exercise device. In examples where the free weight assembly is incorporated into a treadmill, the free weight cradle may have a first portion incorporated into a first side of the treadmill and a second portion of the cradle may be incorporated into a second side of the treadmill. Each portion of the free weight cradle may position the free weights within a convenient reach of each of the user's hands when the user is standing on the treadmill's deck. Thus, the free weights may be accessible to the user as the user is on the exercise deck.

The treadmill may include a running deck that has a first pulley and a second pulley. A tread belt may surround the first pulley and the second pulley. A motor can be attached to either the first or the second pulley so that as the motor rotates its shaft, the connected pulley also rotates. The rotation of the connected pulley, then drives movement of the tread belt. In those examples where the treadmill includes just a single motor, the movement of the tread belt drives movement of the other pulley that is not connected to the motor.

For purposes of this disclosure, the term "free weight" refers broadly to free weights that are intended to be used to execute an anaerobic exercise. In some cases, the free weights may be intended to be held in a single hand. Frees weights intended for the user's first hand are positioned in the first portion of the free weight cradle, and free weights intended for the user's second hand are positioned in the second portion of the free weight cradle. These free weights may include dumbbells, kettle balls, balls, adjustable dumbbells, weight plates, Bulgarian bags, other types of weighted bags, barbells, curl bars, other types of free weights, or combinations thereof.

In some cases, the user can work out on the portion of the exercise deck that includes the tread belt. In this example, the user may desire to mix up the anaerobic exercise and aerobic exercise portions of his or her workout. During the anaerobic portions of the workout, the tread belt may be stopped while the user performs the free weight exercises. When the anaerobic portion of the workout is completed, the user may resume the operation of the tread belt to perform an aerobic portion of the workout. In other examples, the user may want to use the free weights while the tread belt is in operation. For example, the user may want to carry dumbbells during a run.

In other examples, the treadmill incorporates a separate area on the exercise deck where the user can perform exercises with the free weights. In some cases, this free weight area may be in the front end of the treadmill proximate an upright portion of the treadmill that has a console. The console can provide information about the user's workout such as the time, distance, and speed at which the user executed the aerobic portions of the workout.

In some situations, the treadmill guides the user with a programmed workout. In some cases, the programmed workout alters the tread belt's speed, the incline of the deck, and other factors affecting the aerobic portion of the workout. Additionally, the programmed workout may include anaerobic portions as well. In these instances, the programmed workout may instruct the user to perform certain types of lifts with the free weights. In some cases, the programmed workout may select the amount of weight that the user is to lift. In embodiments where the free weight cradle includes an adjustable dumbbell, the treadmill may cause the adjustable dumbbell to select the amount of weight prescribed by the programmed workout. In other instances, the treadmill may allow the user to manually select the amount of weight to connect to the dumbbell's handle even if the programmed workout is providing the user with instructions to lift a predetermined amount.

The predetermined amount of weight recommended in the programmed workout may be based on information about the user. This information may be derived from a history compiled with fitness trackers, previous workouts on the treadmill, age information, height information, body composition information, gender information, other types of personal information, or combinations thereof. In some instances, the treadmill is in communication with a remote computing device that contains a user profile detailing fitness information about the user. The treadmill or a remote computing device may also take into consideration the user's fitness goals when selecting the type of lifts to perform, the amount of weight to perform with the lifts, and the number of repetitions.

In some cases, the programmed workout's instructions are presented to the user through a display in the console. The programmed workout can present the number of lifts to perform, the type of lifts to perform, the next type of exercise to perform, and so forth. In some case, the display screen can instruct the user on how to perform the lift. For instance, the programmed workout may instruct the user to perform negatives by lifting up quickly and lowering the free weight slowly, or the programmed workout may instruct the user to perform the same type of lift a different way, such as instructing the user to lift up and lower the free weight at the same rate. In other examples, a speaker may be used to audibly instruct the user about the programmed workout.

Information relating to both the anaerobic portions of the workout and the aerobic portions of the workout can be presented to the user. For instance, the repetition count may be presented in the display, the calories burned during the workout may be presented in the display, the user's heart rate, or other physiological parameters may be presented in the display, and so forth.

In some case, the treadmill is in communication with a remote device, and the information recorded about the workout is sent to the remote device. In one instance, the information is sent to the user's mobile device and the user follows the workout with his or her mobile device.

The display that depicts exercise instructions to the user may include any appropriate type of instructions for any type of activity associated with a work out. For example, the instructions may include for an aerobic activity, an anaerobic activity, a stretching activity, a warm up activity, a cool down activity, another type of activity, or combinations thereof. The instructions provide details about the exercise activity that the user is instructed to currently be executing, an activity that the user will be instructed to execute after completing the current activity, other activities that the will be executed in the future during the workout, activities that have already been executed during the workout, and combinations thereof. In some examples, the display tracks the user's success in accomplishing the exercise, at least one of the user's physiological parameters during the execution of the activity, or combinations thereof. In some examples, the display presents both aerobic and anaerobic activities at the same time.

The instruction system for instructing the user about the workout may include a combination of hardware and programmed instructions for executing the functions of the instruction system. The instruction system may include processing resources that are in communication with memory resources. Processing resources include at least one processor and other resources used to process the programmed instructions. As described herein, the memory resources may represent generally any memory capable of storing data such as programmed instructions or data structures used by the instruction system.

The processing resources may include I/O resources that are capable of being in communication with a remote device that stores the user information, workout history, external resources, databases, or combinations thereof. The remote device may be a mobile device, a cloud based device, a computing device, another type of device, or combinations thereof. In some examples, the system communicates with the remote device through a mobile device which relays communications between the instruction system and the remote device. In other examples, the mobile device has access to information about the user. The remote device may collect information about the user throughout the day, such as tracking calories, exercise, activity level, sleep, other types of information, or combination thereof.

The remote device may execute a program that can provide useful information to the instruction system. An example of a program that may be compatible with the principles described herein includes the iFit program which is available through www.ifit.com identified above. An example of a program that may be compatible with the principles described in this disclosure is described in U.S. Pat. No. 7,980,996 issued to Paul Hickman. U.S. Pat. No. 7,980,996 is herein incorporated by reference for all that it discloses. In some examples, the user information accessible through the remote device includes the user's age, gender, body composition, height, weight, health conditions, other types of information, or combinations thereof.

The processing resources, memory resources, and remote devices may communicate over any appropriate network and/or protocol through the input/output resources. In some examples, the input/output resources includes a transmitter, a receiver, a transceiver, or another communication device for wired and/or wireless communications. For example, these devices may be capable of communicating using the ZigBee protocol, Z-Wave protocol, BlueTooth protocol, Wi-Fi protocol, Global System for Mobile Communications (GSM) standard, another standard, or combinations thereof. In other examples, the user can directly input some information into the instruction system through a digital input/output mechanism, a mechanical input/output mechanism, another type of mechanism, or combinations thereof.

The memory resources may include a computer readable storage medium that contains computer readable program code to cause tasks to be executed by the processing resources. The computer readable storage medium may be a tangible and/or non-transitory storage medium. The computer readable storage medium may be any appropriate storage medium that is not a transmission storage medium. A non-exhaustive list of computer readable storage medium types includes non-volatile memory, volatile memory, random access memory, write only memory, flash memory, electrically erasable program read only memory, magnetic based memory, other types of memory, or combinations thereof.

In some cases, the user can select a programmed workout from a library of programs that are included in the memory resources, which may be physically located in the free weight assembly, an exercise device associated with the free weight assembly, or a remote device. In other examples, the user selects a goal, like a weight strength goal, a fat loss goal, a muscle gain goal, a health goal, a fitness goal, another type of goal, or combinations thereof, and the memory resources cause the processing resources to create a programmed workout that is customized to the user's goals. The programmed workout can control the operating parameters of the free weight assembly, such as causing the indicator to activate when it is time for the user to lift a free weight. The programmed workout can also cause certain indicators to illuminate to assist the user in knowing which free weight to use. In those examples where the free weight assembly is incorporated into another exercise machine (e.g. treadmill, elliptical trainer, stationary bicycle, stepper machine, rowing machine, or another type of exercise machine), the programmed workout can control the parameters of that exercise machine as well. For example, the programmed workout can cause the processor to control the speed of a tread belt; the incline of the treadmill's deck; the side to side tilt of the treadmill's deck; a resistance level of an elliptical trainer, a stationary bicycle, or another type of exercise machine; entertainment on the exercise machine; a volume level; a climate control; a vibration level; a scene depicted in a display; another parameter of the exercise machine; or combinations thereof.

An aerobic exercise instructor incorporated into the exercise device may represent programmed instructions that, when executed, cause the processing resources to control the aerobic portion of the user's workout. The aerobic exercise may include, but is not limited to, walking, running, shuffling, skipping, biking, jumping, or otherwise moving with the tread belt in operation. The aerobic exercise instructor may control the speed and/or incline of the tread belt based on the user's heart rate or other physiological readings, the user's goals, a programmed workout, inputs from the user, or combinations thereof.

An anaerobic exercise instructor incorporated into the exercise device may represent programmed instructions that, when executed, cause the processing resources to control the anaerobic portions of the user's workout. The anaerobic exercise instructor may instruct the user to perform lifts, perform a number of repetitions, perform a type of lift, perform other aspects of the anaerobic portion of the workout, or combinations thereof.

A weight selector incorporated into the exercise device may represent programmed instructions that, when executed, cause the processing resources to select the amount of weight to lift. In one embodiment, the free weights include an adjustable dumbbell, and a selector is incorporated into the free weight assembly. In those examples where the free weights include an adjustable dumbbell, the selector may mechanically adjust the connections between the weight plates and dumbbell's handle so that the desired amount of weight is automatically attached to the dumbbell's handle. In this situation, the user does not have to make manual adjustments to the dumbbell. In other examples, the weight selector indicates to the user which of multiple free weights the user is to lift. In this example, the free weight assembly may include multiple free weights with varying amounts of mass. Each of the potential free weights that could be lifted by the user are associated with a single indicator. To communicate to the user which of the multiple free weights is to be lifted, the programmed workout can cause the indicator associated with the desired free weight to activate. In this case, the user can determine to lift the free weight that is associated with the activated indicator.

The processing resources may determine the time when the user is to perform the lift with the free weight. The processing resources may be in communication with an input of the free weight assembly. The processing resources may send a signal to the input to activate the indicator. The processing resources may send the signal to the input in response to determining that the user has completed a previously assigned portion of the workout. In another example, the signal is sent in response to a predetermined time lapse from when the user was previously assigned to perform an aerobic portion of the workout. In yet another example, the signal is sent to the input in response to a physiological condition. In one of these examples, the programmed workout may instruct the user to run for a certain amount of time within a certain heart rate zone. In this example, after a heart rate monitor communicates to the processing resources that the user's heart rate has been in the target zone for the predetermined amount of time, the signal is sent to activate the indicator.

In some circumstances the processing resources provide instructions to the free weight assembly that the indictors are to be activated under certain conditions. The processor may depend on other instruments to provide the information that the specified conditions are meet. In some cases, an activity tracker worn by the user that tracks the user's age, fitness level, amount of sleep, calorie input, calorie burn, activity level, workout histories, health conditions, and/or other types of information may send information directly to the free weight assembly's input. The information received by from the activity tracker may indicate whether specified conditions are meet and thereby cause the indicator to activate.

In some circumstances, the user can provide an input into the free weight assembly or the exercise device when he or she has completed the assigned lift. In that circumstance, the programmed workout can instruct the user to perform another activity or indicate that the workout is finished. In those circumstances where the workout is to continue, the programmed workout may instruct the user to perform another type of lift, to rest, to perform another set of repetitions of the same lift, to perform an aerobic exercise on the exercise machine, perform another activity, or combinations thereof.

In other cases, the exercise device and/or the exercise machine can determine when the user has finished the lift. In one example, the programmed workout can determine that the lift is finished when the user returns a free weight to the cradle. In another example, the programmed workout can determine when the user has finished the lifts through another type of sensor, such as an optical sensor, a weight scale associated with the exercise device or otherwise networked to the exercise device and/or networked to the free weight assembly. In another example, a magnetic counter may be incorporated into the exercise device and/or the free weight assembly. In this embodiment, a magnet may sense each time the free weights move through an area near the magnetic sensor, which can signal to the programmed workout that another lift has been performed.

Further, the memory resources may be part of an installation package. In response to installing the installation package, the programmed instructions of the memory resources may be downloaded from the installation package's source, such as a portable medium, a server, a remote network location, another location, or combinations thereof. Portable memory media that are compatible with the principles described herein include DVDs, CDs, flash memory, portable disks, magnetic disks, optical disks, other forms of portable memory, or combinations thereof. In other examples, the program instructions are already installed. Here, the memory resources can include integrated memory such as a hard drive, a solid state hard drive, or the like.

In some examples, the processing resources and the memory resources are located within the treadmill, the adjustable dumbbell, a mobile device, an external device, another type of device, or combinations thereof. The memory resources may be part of any of these device's main memory, caches, registers, non-volatile memory, or elsewhere in their memory hierarchy. Alternatively, the memory resources may be in communication with the processing resources over a network. Further, data structures, such as libraries or databases containing user and/or workout information, may be accessed from a remote location over a network connection while the programmed instructions are located locally.

While the examples above have been described with the free weight assembly being incorporated into an exercise machine, such as a treadmill, the free weight assembly may be independent of another exercise device. In one example, the free weight assembly includes a stand, and a cradle incorporated into the stand where the free weights can be located. In this example, the free weights may be an adjustable dumbbell, and the cradle has a selection mechanism that connects and disconnects the weight plates from the dumbbell's handles. The programmed workout that indicates when the time has arrived for the user to pick up the free weights may also cause the selection mechanism to connect and/or disconnect certain weight plates so that the adjustable dumbbell is the correct weight for the intended lift. In other cases, the indicator activates indicating that the adjustable dumbbell is ready for the lift after the selection mechanism has connected and/or disconnected the appropriate weight plates.

Any appropriate type of indicator may be used to communicate to the user to remove the free weight. In some examples, the indicator includes a light that illuminates when the time has arrived for removing the weight. In some cases where the cradle holds multiple free weights of varying amounts, multiple lights may be incorporated into the cradle or into the free weights themselves. When the time has arrived to remove a specific free weight, the light associated with that specific free weigh illuminates indicating to the user to remove that free weight.

In yet another example, the indicator includes a speaker. In this example, the speaker can broadcast audio instructions for the user to remove the weight. In examples where the indicator includes a speaker, the indictor can provide the user with other types of information, like the number of repetitions, the lift type, safety recommendations, pacing information, other types of information associated with the lift or other aspects of the workout, or combinations thereof.

In another example, the indicator may include a display that can present written messages to the user about lifting the weight, the amount of weight to lift, pacing information, safety recommendations, the lift type, or other types of information relating to the lift or other portions of the workout.

In those examples where an adjustable dumbbell is used, the programmed workout may send instruction to the adjustable dumbbell that connects and/or disconnects weight plates to the dumbbell's handle. In one example, the cradle may include selectors that are incorporated into the troughs defined in the cradle. These selectors may be spaced within the cradle so that each of the selectors correspond to each weight plate of the dumbbell's weight set. As the dumbbells are received in the troughs, the selectors protrude into the cavities defined in the weight plates. The linear position of the selectors is adjustable and is controlled based on the programmed workout's instructions. The linear position of the selectors determines whether the weight associated with the selector is connected to the dumbbell or released from the dumbbell.

The selector may include a rod linearly movable to engage a selection mechanism in the adjustable dumbbell through the cavity. A linear actuator may cause the rod to be in a first linear position or a second linear position. In the first linear position, a distal end of the selector engages the connection features causing the connection features to disconnect the weight from the dumbbell's handle.

In the second linear position of the selector, the distal end moves away from the connection features. In this type of situation, the distal end may not inhibit the connection features from moving. The connection features may be spring loaded or otherwise urged into the interlocking position when no opposing force is applied to put the connection features into the release position. Thus, as the distal end moves out of the way, the connection features move back into the interlocking position.

When the adjustable dumbbells are docked in the cradle, the selector can disconnect the corresponding weights by moving the rod into the first linear position. For those weights that are to remain connected to the adjustable dumbbells, the rods can be positioned so that the rods do not cause the connection features to release the weights. Alternatively, the rods may move to release the weights and reconnect them.

What is claimed is:

1. An exercise system comprising:

a stationary bicycle;

a free weight cradle incorporated into the stationary bicycle and configured to hold one or more free weights that are removable from the free weight cradle;

pedals incorporated into the stationary bicycle and configured to be movable with respect to the free weight cradle during execution of a programmed workout;

a display;

one or more processors; and memory storing programmed instructions of the programmed workout that, when executed by the one or more processors, cause the one or more processors to:

automatically alternate, by the programmed instructions of the programmed workout, between biking portions of the programmed workout and lifting portions of the programmed workout;

automatically control, by the programmed instructions of the programmed workout, a resistance level of the pedals during the biking portions of the programmed workout; and automatically present, by the programmed instructions of the programmed workout, lifting instructions on the display, the lifting instructions configured to instruct a user on lifting the one or more free weights during the lifting portions of the programmed workout.

2. The exercise system of claim 1, wherein the lifting instructions further instruct the user on when a time has arrived to remove the one or more free weights from the free weight cradle.

3. The exercise system of claim 1, wherein the lifting instructions further instruct the user on performing a specific exercise with the one or more free weights.

4. The exercise system of claim 1, wherein the lifting instructions further instruct the user on types of lifts to perform, and a number of repetitions to perform with each of the types of lifts, using the one or more free weights.

5. The exercise system of claim 1, wherein the lifting instructions further instruct the user on how to perform a lift using the one or more free weights.

6. The exercise system of claim 1, wherein the lifting instructions further instruct the user on a safety precaution about a lift using the one or more free weights.

7. The exercise system of claim 1, wherein the lifting instructions further instruct the user on pacing information associated with a lift using the one or more free weights.

8. The exercise system of claim 1, wherein the lifting instructions further instruct the user to perform negatives using the one or more free weights by lifting up the one or more free weights relatively quickly and lowering down the one or more free weights relatively slowly.

9. The exercise system of claim 1, wherein the lifting instructions further instruct the user to perform to lift up the one or more free weights and lower down the one or more free weights at a same rate.

10. The exercise system of claim 1, wherein the lifting instructions include written words and images.

11. The exercise system of claim 1, wherein the lifting instructions further instruct the user to lift the one or more free weights in an area separate the pedals in a front end of the stationary bicycle.

12. The exercise system of claim 1, wherein:

the exercise system further comprises a speaker; and the speaker is configured to audibly broadcast at least a portion of the lifting instructions.

13. The exercise system of claim 1, wherein the programmed instructions of the programmed workout, when executed by the one or more processors, further cause the one or more processors to simultaneously:

automatically present, by the programmed instructions of the programmed workout, biking instructions on the display during a current one of the biking portions of the programmed workout, the biking instructions configured to instruct the user on moving the pedals during the current one of the biking portions of the programmed workout; and automatically present, by the programmed instructions of the programmed workout, lifting instructions on the display for an upcoming one of the lifting portions of the programmed workout.

14. The exercise system of claim 1, wherein the programmed instructions of the programmed workout, when executed by the one or more processors, further cause the one or more processors to:

automatically present, by the programmed instructions of the programmed workout, warm up instructions on the display, the warm up instructions configured to instruct the user on performing a warm up activity of the programmed workout; and automatically present, by the programmed instructions of the programmed workout, cool down instructions on the display, the cool down instructions configured to instruct the user on performing a cool down activity of the programmed workout.

15. The exercise system of claim 1, wherein:

the one or more processors and the memory are incorporated into the stationary bicycle;

the memory further stores a library of programmed workouts from which the programmed workout can be selected by the user; and the library of programmed workouts is downloaded to the memory from a remote network location over a Wi-Fi network connection.

16. The exercise system of claim 1, wherein the free weight cradle includes one or more recesses configured to prevent the one or more free weights from slipping off the free weight cradle and each sized to dimensions of the free weight configured to be held in the recess.

17. The exercise system of claim 1, wherein the free weight cradle includes one or more lips configured to prevent the one or more free weights from slipping off the free weight cradle.

18. The exercise system of claim 1, wherein the free weight cradle includes:

a first portion configured to hold a first dumbbell for a first hand of the user; and a second portion configured to hold a second dumbbell for a second hand of the user.

19. An exercise system comprising:

a stationary bicycle;

a free weight cradle incorporated into the stationary bicycle and configured to hold one or more free weights that are removable from the free weight cradle;

pedals incorporated into the stationary bicycle and configured to be movable with respect to the free weight cradle during execution of a programmed workout;

a display;

one or more processors incorporated into the stationary bicycle; and memory incorporated into the stationary bicycle, the memory storing a library of programmed workouts from which the programmed workout can be selected by a user, the memory configured to have the library of programmed workouts downloaded to the memory from a remote network location over a Wi-Fi network connection, the memory further storing programmed instructions of the programmed workout that, when executed by the one or more processors, cause the one or more processors to:

automatically present, by the programmed instructions of the programmed workout, warm up instructions on the display, the warm up instructions configured to instruct the user on performing a warm up activity of the programmed workout;

automatically alternate, by the programmed instructions of the programmed workout, between biking portions of the programmed workout and lifting portions of the programmed workout;

automatically control, by the programmed instructions of the programmed workout, a resistance level of the pedals during the biking portions of the programmed workout;

automatically present, by the programmed instructions of the programmed workout, biking instructions on the display, the biking instructions configured to instruct the user on moving the pedals during the biking portions of the programmed workout;

automatically present, by the programmed instructions of the programmed workout, lifting instructions on the display, the lifting instructions configured to instruct the user on lifting the one or more free weights during the lifting portions of the programmed workout; and automatically present, by the programmed instructions of the programmed workout, cool down instructions on the display, the cool down instructions configured to instruct the user on performing a cool down activity of the programmed workout.

20. An exercise system comprising:

a stationary bicycle;

a dumbbell cradle incorporated into the stationary bicycle and configured to hold first and second dumbbells that are removable from the dumbbell cradle, the dumbbell cradle including a first portion with a first recess configured to hold the first dumbbell for a first hand of a user, the dumbbell cradle further including a second portion with a second recess configured to hold the second dumbbell for a second hand of the user, the first and second recesses configured to prevent the first and second dumbbells from slipping off the dumbbell cradle, the first recess sized to dimensions of the first dumbbell, the second recess sized to dimensions of the second dumbbell;

pedals incorporated into the stationary bicycle and configured to be movable with respect to the dumbbell cradle during execution of a programmed workout;

a display;

one or more processors; and memory storing programmed instructions of the programmed workout that, when executed by the one or more processors, cause the one or more processors to:

automatically alternate, by the programmed instructions of the programmed workout, between biking portions of the programmed workout and lifting portions of the programmed workout;

automatically control, by the programmed instructions of the programmed workout, a resistance level of the pedals during the biking portions of the programmed workout;

automatically present, by the programmed instructions of the programmed workout, biking instructions on the display, the biking instructions configured to instruct the user on moving the pedals during the biking portions of the programmed workout; and automatically present, by the programmed instructions of the programmed workout, lifting instructions on the display, the lifting instructions configured to instruct the user on lifting the first and second dumbbells during the lifting portions of the programmed workout.

* * * * *